US006565079B1

(12) United States Patent
Kakegawa et al.

(10) Patent No.: US 6,565,079 B1
(45) Date of Patent: May 20, 2003

(54) DOCUMENT FEEDER, DOCUMENT FEED METHOD, AND IMAGE CAPTURE DEVICE

(75) Inventors: Hirotoshi Kakegawa, Kawasaki (JP); Tamio Amagai, Kawasaki (JP); Noriaki Yamazaki, Kawasaki (JP); Yoshio Tabata, Kawasaki (JP)

(73) Assignee: PFU Limited, Kahoku-gun (JP)

( * ) Notice: Subject to any disclaimer, the term of this patent is extended or adjusted under 35 U.S.C. 154(b) by 173 days.

(21) Appl. No.: 09/697,361

(22) Filed: Oct. 27, 2000

(30) Foreign Application Priority Data

Jan. 28, 2000 (JP) ..... 2000-020522

(51) Int. Cl.[7] ..... B65H 3/06
(52) U.S. Cl. ..... 271/125; 271/121
(58) Field of Search ..... 271/121, 124, 271/125, 122

(56) References Cited

U.S. PATENT DOCUMENTS 4,368,881 A * 1/1983 Landa ..... 192/126
5,129,642 A * 7/1992 Svyatsky et al. ..... 271/10.03
5,158,279 A * 10/1992 Laffey et al. ..... 192/110 R
6,199,854 B1 * 3/2001 Tranquilla et al. ..... 271/121

FOREIGN PATENT DOCUMENTS

| | | |
|---|---|---|
| JP | 7-160930 | 6/1995 |
| JP | 11-314775 | 11/1999 |

* cited by examiner

*Primary Examiner*—Christopher P. Ellis
*Assistant Examiner*—Mark A. Deuble
(74) *Attorney, Agent, or Firm*—Armstrong, Westerman & Hattori, LLP

(57) ABSTRACT

The present invention relates to a document feeder, document feed method, and image capture device. The document feeder includes a sheet separation mechanism that restricts the number of sheets to be fed by a pull-in portion. The sheet separation mechanism includes a first separation portion that contacts the sheet, and moves so as to feed the sheet, a second separation portion, located opposite to the first separation portion, which defines a part of a sheet feed path between the second and first separation portions, and moves so as to allow the sheet to be fed, and a brake portion that variably applies to the second separation portion a load allowing the second separation portion to move.

16 Claims, 30 Drawing Sheets

DOCUMENT FEEDER, DOCUMENT FEED METHOD, AND IMAGE CAPTURE DEVICE

BACKGROUND OF THE INVENTION

The present invention relates generally to document feeders, document feed methods, and image capture or reading devices, and more particularly to an automatic document feeder (ADF) and automatic document feed method in which feed a sheet from a stack of papers one by one. The document feeder and document feed method of the present invention are suitable for use with an ADF for in an image scanner, a photocopier, a facsimile unit, and other image capture devices.

Document feeders for use with image capture devices are classified into manual document feeders (MDFs) that require user's sheet-by-sheet placement of sheet to be captured on a specified table, and automatic document feeders that automatically feed in a sheet to be captured from one or more sheets which have been placed by a user on a specified table. Thus, whereas the MDFs that require a user to separate sheets to be captured into a single one, the ADFs need include separation/feed means for separating a sheet to be captured from a plurality of sheets, and feeding the same to an image capture device.

A conventional ADF 1, as shown in FIGS. 32 and 33, typically includes a pick roller 2, a separation roller 4, a separation belt 6, a torque limiter 8, a leaf spring 10, a separation pad 12, and a transmission type sensor 14. Hereupon, FIG. 32 is a schematic sectional view of principal part of the conventional ADF 1. FIG. 33 is a schematic front view of a separation belt unit 5 in the ADF 1.

The pick roller 2, generally referred to as a feed roller, a pull-in roller, a dispense roller, or the like, is driven by a driving device (not shown) to rotate in an arrow direction in the drawing. The pick roller 2 touches a top of stacked papers placed on a hopper (not shown), and feeds one or more sheets from the top between the separation roller 4 and the separation pad 12. The pick roller 2 is located above of the hopper in the width direction of and in the middle of the hopper, so that the pick roller 2 and the hopper may move relative to each other. The separation belt 6 and the separation pad 12 are disposed opposite to the separation roller 4, and separate sheets into a single sheet in cooperation with the separation roller 4 if the pick roller 2 carries a plurality of sheets.

The separation belt 6 is an endless belt that moves depending upon the separation roller 4, and looped over a pair of rollers 7*a* and 7*b* that are spaced in a sheet feed direction. A torque of a specified value is fixed by the torque limiter 8 and applied to the separation belt 6. A compression force (separation load) of the separation belt 6 is applied to the separation roller 4 through the leaf spring 10, and this force determines a frictional force (driving force), which the separation belt 6 receives from the sheet. Thus, the separation belt 6 does not rotate unless a driving force larger than a braking force determined by the set torque and a size (diameter) of the separation belt 6 is applied to the separation belt 6. Normally, the compression force and the torque are determined in such a manner: (1) that if one sheet is inserted between the separation roller 4 and the separation belt 6, the sheet is held and carried without slippage by the separation belt 6; and (2) that if two sheets are inserted between the separation roller 4 and the separation belt 6, one of the sheets in contact with the separation belt 6 is held and stopped by the separation belt 6 while only the other sheet at the side of the separation roller 4 is carried to the next stage. The separation belt 6 and the torque limiter 8 are integrated to form a replaceable separation belt unit 5.

The transmission type sensor 14 detects a sheet at a downstream of the separation roller 4 and the separation belt 6. An output of the transmission type sensor 14 is connected with a timer means such as a counter (not shown) and a controller, whereby the controller may work out a sheet travel time using the timer means and an output from the transmission type sensor as a trigger. As a result, if a current sheet travel time is longer than a reference value, the controller determines that the sheet (i.e., sheet travel time) is longer than usual, assuming, for example, that two or more partially overlapped sheets are being carried.

However, the conventional ADF has several disadvantages. First, the conventional ADF cannot separate sheets stably (or cannot pick up only one sheet reliably). This is contrary to a recent demand on ADFs for quick feeding of various types of sheets with distinctive properties. In addition, even the same type of sheets may differ in separating condition according to temperature and humidity. An excessively low torque would cause double feeding, then resulting in jamming and poor-quality capturing, or the like. An excessively high torque would not feed any sheet, thereby slipping and jamming sheets on the separation belt 6. Worse yet, a user cannot easily adjust such an improper torque. For example, some experience is required to adjust the torque by the torque limiter 8 and the pressing force by the leaf spring 10. An inappropriate adjustment would make unstable the separation belt unit 5 and other neighboring members, causing a vibration associated with a feed action, and thereby rendering unstable the sheet separating action.

In addition, the conventional ADF 1 has no means for easily identifying a cause of unsuccessful sheet separation. For example, the ADF 1 has no means for checking whether the exchangeable separation belt unit 5 is properly installed. An improperly installed or uninstalled separation belt unit 5 would sometimes enable the ADF 1 to separate and feed a highly rigid sheet (e.g., cardboard) by virtue of the separation roller 2 and the separation pad 12. However, an unsuccessful sheet separation occurs when a user uses a low rigid sheet such as a thin sheet of paper in this condition. Thus, the user cannot easily ascribe the unsuccessful sheet separation to an improperly installed or uninstalled separation belt unit 5. Similarly, the conventional ADF 1 has no means for checking whether the separation belt 6 is worn out, and thus a user cannot easily ascribe the unsuccessful sheet separation to the worn separation belt 6.

Still disadvantageously, the conventional ADF 1 cannot detect double feeding reliably using the transmission type sensor 14. because an output of the transmission type sensor 14 varies with sheet's property (such as color, thickness, type, material. and the like). In other words, the transmission type sensor 14 typically uses light-emitting and light-sensitive elements, but they do not exhibit such a high performance as to detect the double sheet feeding with transmittance. In particular, the transmission type sensor 14 can hardly detect the double feeding where different types of sheets are being fed.

Moreover, the separation belt 6 and the torque limiter 8 are both consumable in the separation belt unit 5, and the replacement of the unit costs much.

BRIEF SUMMARY OF THE INVENTION

Accordingly, it is a general and exemplified object of the present invention to provide a novel and useful document feeder, document feed method, and image capture device, in which the above disadvantages are eliminated.

Another exemplified and more specific object of the present invention is to provide a document feeder, document feed method, and image capture device that deliver high performance in sheet separation.

Another exemplified object of the present invention is to provide a document feeder, document feed method, and image capture device that serve to identify a failed component in a sheet separation mechanism.

Another exemplified object of the present invention is to provide a document feeder, document feed method, and image capture device that can reliably detect the double sheet feeding.

In order to achieve the above objects, a document feeder as one aspect of the present invention includes a pull-in portion that contacts a topmost sheet among a plurality of sheets and feeds one or more sheets including the topmost sheet, and a sheet separation mechanism that restricts the number of sheets to be fed by the pull-in portion. The sheet separation mechanism includes a first separation portion that contacts the sheet, and moves so as to feed the sheet, a second separation portion, located opposite to the first separation portion, which defines a part of a sheet feed path between the second and first separation portions, and moves so as to allow the sheet to be fed, and a brake portion that variably applies to the second separation portion a load allowing the second separation portion to move. This document feeder can adjust a braking force (load) properly according to various types of sheets.

A document feed method as another aspect of the present invention includes the steps of sequentially pulling in stacked sheets from a top thereof, restricting using a sheet separation mechanism the number of sheets to be fed, the sheet separation mechanism including a first separation portion that contacts the sheet, a second separation portion, located opposite to the first separation portion, which defines a part of a sheet feed path between the second and first separation portions, and moves so as to allow the sheet to be fed, and applying variably to the second separation portion a load allowing the second separation portion to move. This document feed method can adjust a braking force (load) properly according to various types of sheets.

A document feed method as still another exemplified embodiment of the present invention includes the steps of sequentially pulling in stacked sheets from a top thereof, restricting using a sheet separation mechanism the number of sheets to be fed, the sheet separation mechanism including a first separation portion that contacts the sheet and move so as to feed the sheet along a sheet feed path, a second separation portion, located opposite to the first separation portion, which defines a part of the sheet feed path between the second and first separation portions, and moves so as to allow the sheet to be fed, detecting a moving condition of the second separation portion, determining whether a double feeding of the sheets has occurred, and measuring a feed time of the sheet, wherein the determining step determines that there is the double feeding of the sheets, when the measuring step measures that the feed time of the sheet is longer than a reference value, and the detecting step detects a motionless and improper movement of the second separation portion. This document feed method determines an existence of a double feeding by taking into account a moving condition of the second separation portion, and thus provides a higher reliability than a method of determining the double feeding only based on a measured sheet feed time period.

The image capture device as one embodiment of the present invention includes the above-described document feeder, and a reader part that reads out information on a sheet that is fed by the document feeder. This image capture device has the same effects as the above-described document feeder.

Other objects and further features of the present invention will become readily apparent from the following description of the embodiments with reference to accompanying drawings.

DETAILED DESCRIPTION OF INVENTION

Figure 1:
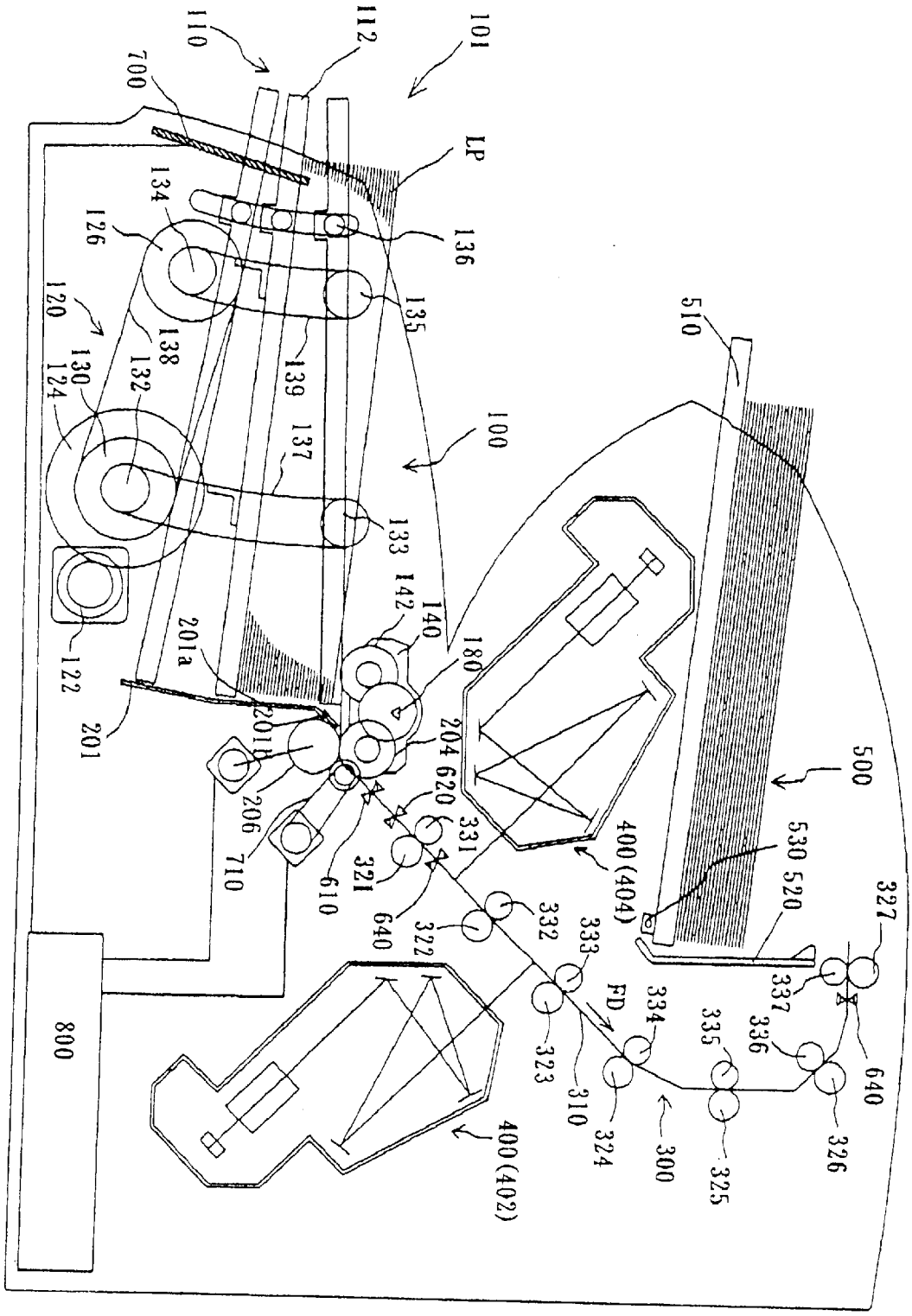
FIG. 1 is a schematic sectional view from the right hand side of a document feeder as one embodiment of the present invention.
Figure 2:
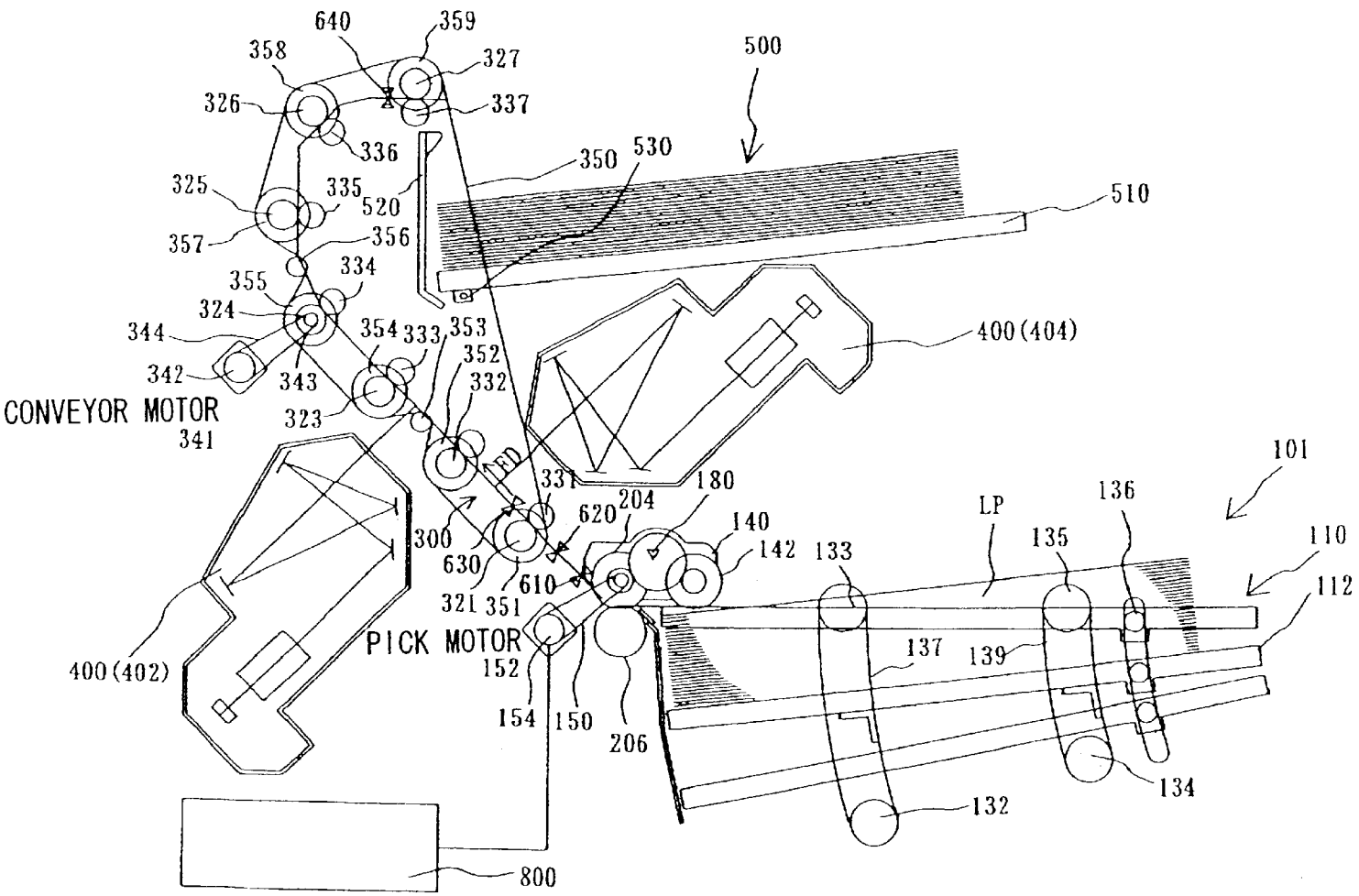
FIG. 2 is a schematic sectional view from the left hand side of the document feeder shown in FIG. 1.
Figure 3:
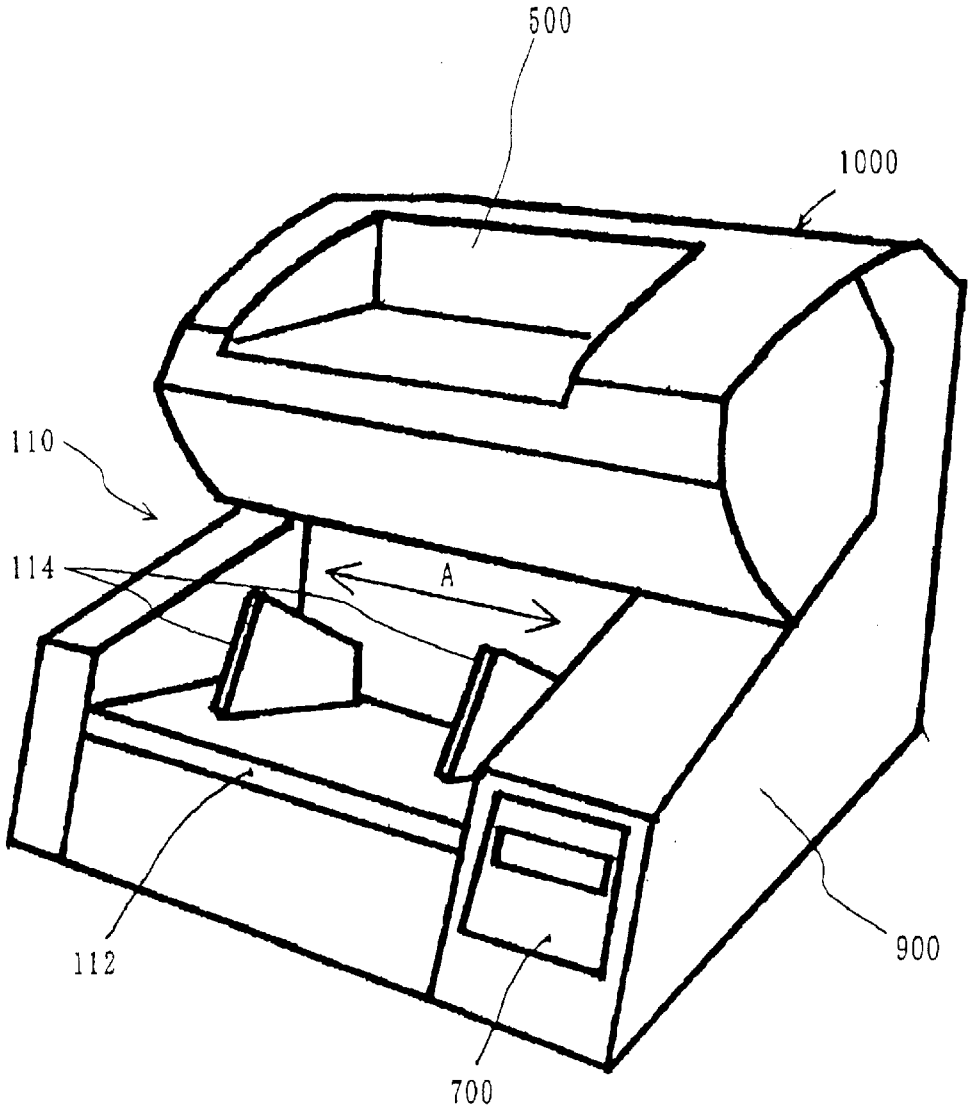
FIG. 3 is a schematic perspective view of an image capture device as one embodiment of the present invention.
Figure 4:
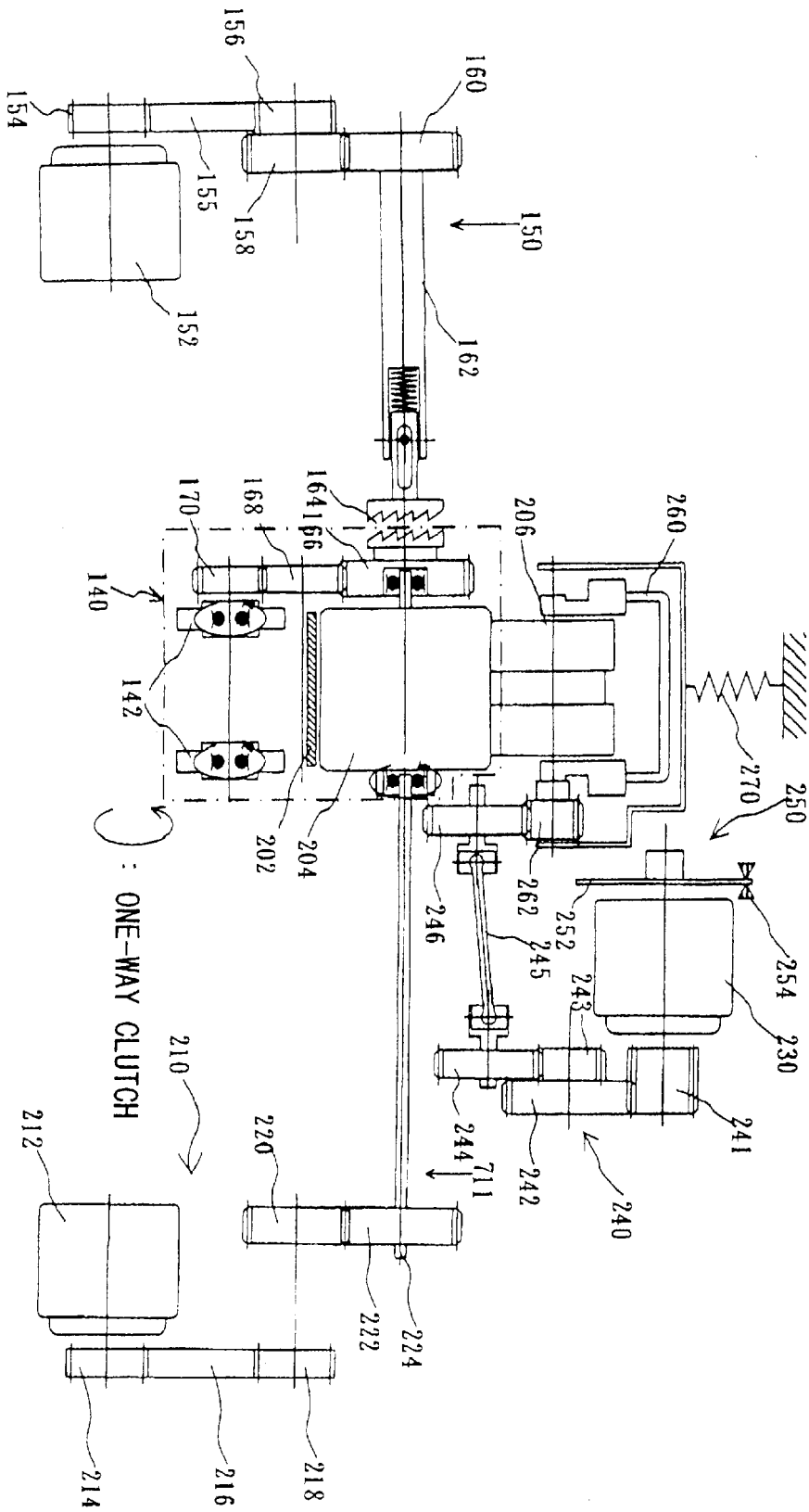
FIG. 4 is a schematic plan view of the document feeder shown in FIG. 1.
Figure 5:
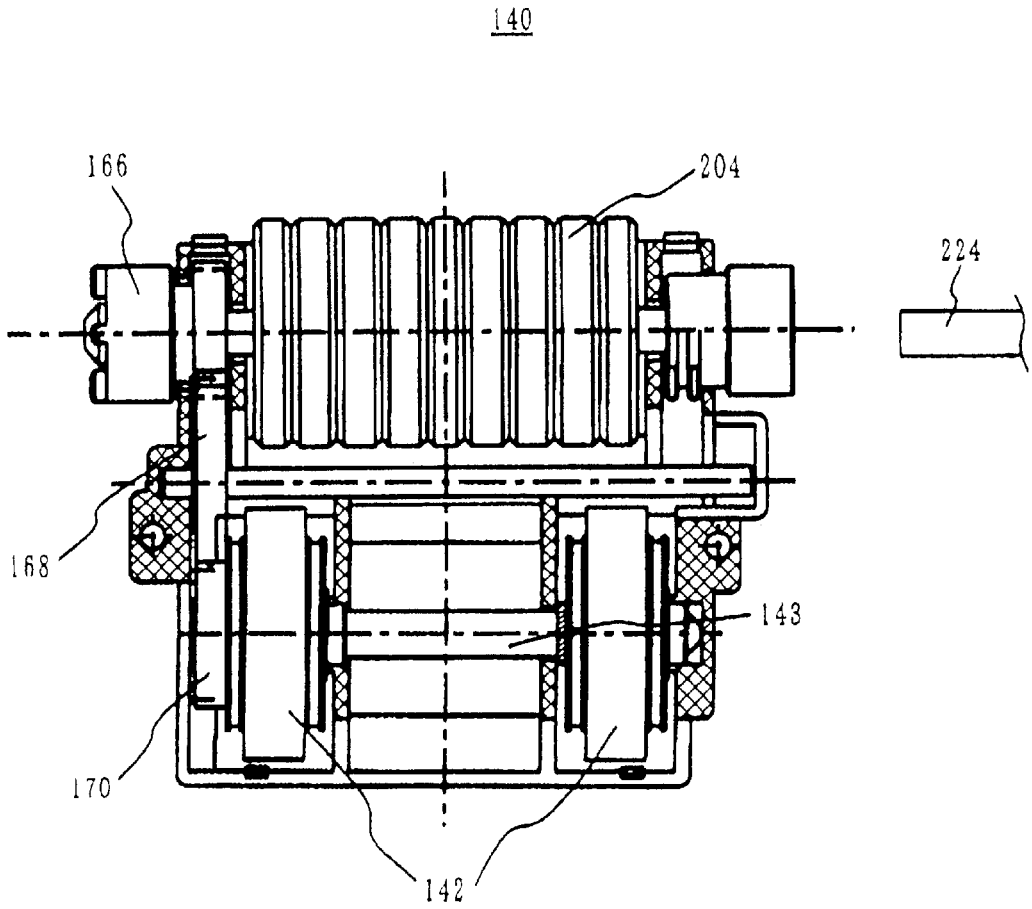
FIG. 5 is a plan view of a pick roller unit in the document feeder shown in FIG. 1.
Figure 6:
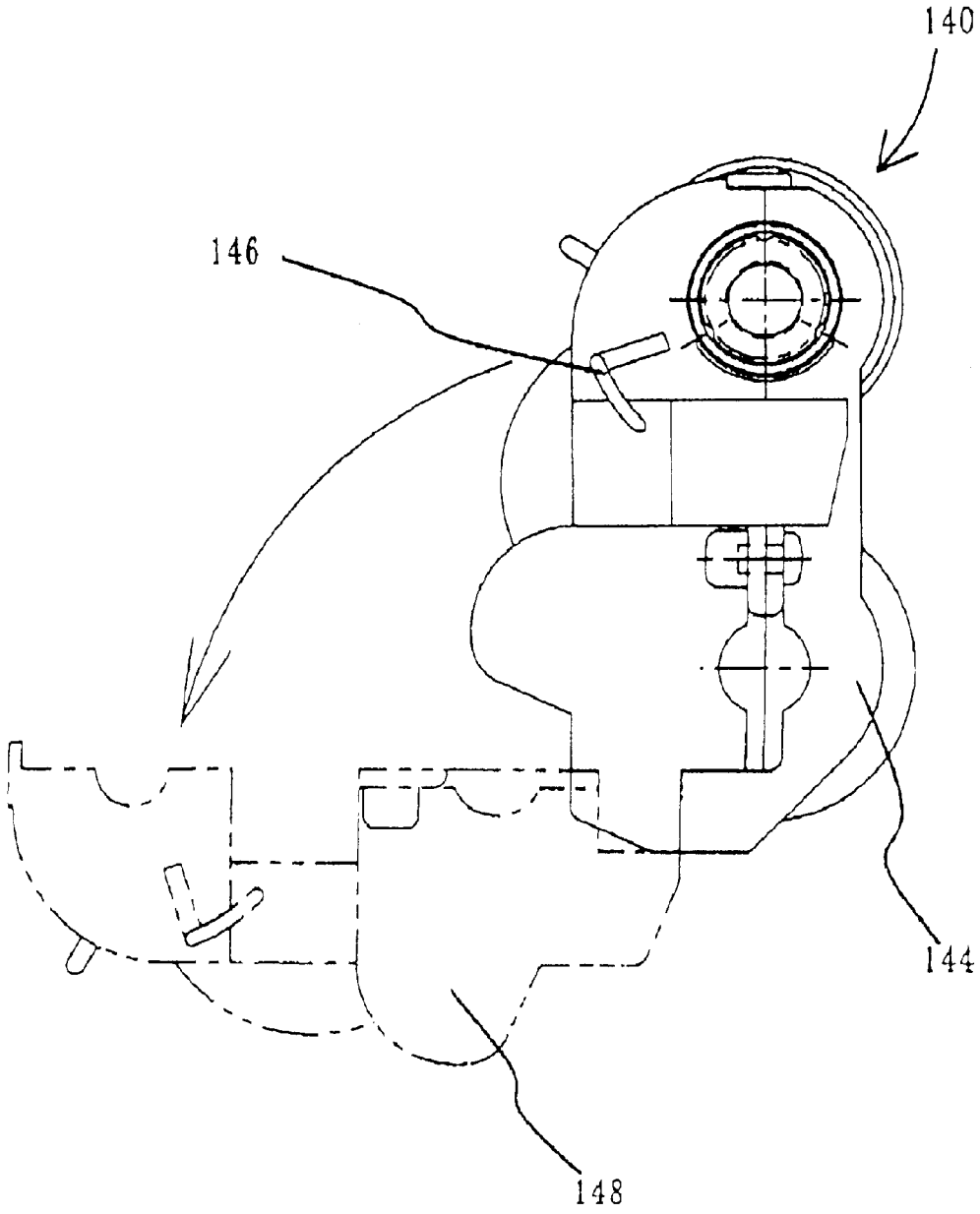
FIG. 6 is a sectional view of a pick roller unit in the document feeder shown in FIG. 1.
Figure 7:
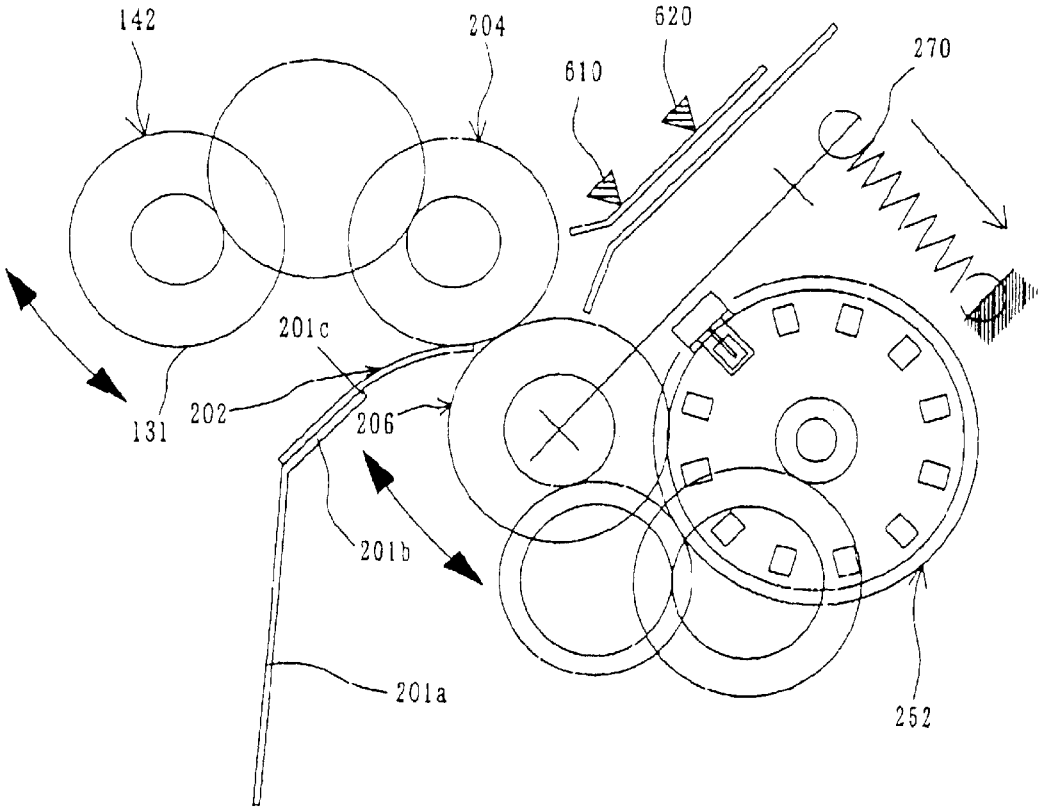
FIG. 7 is a partially enlarged schematic section of the document feeder shown in FIG. 1.
Figure 8:
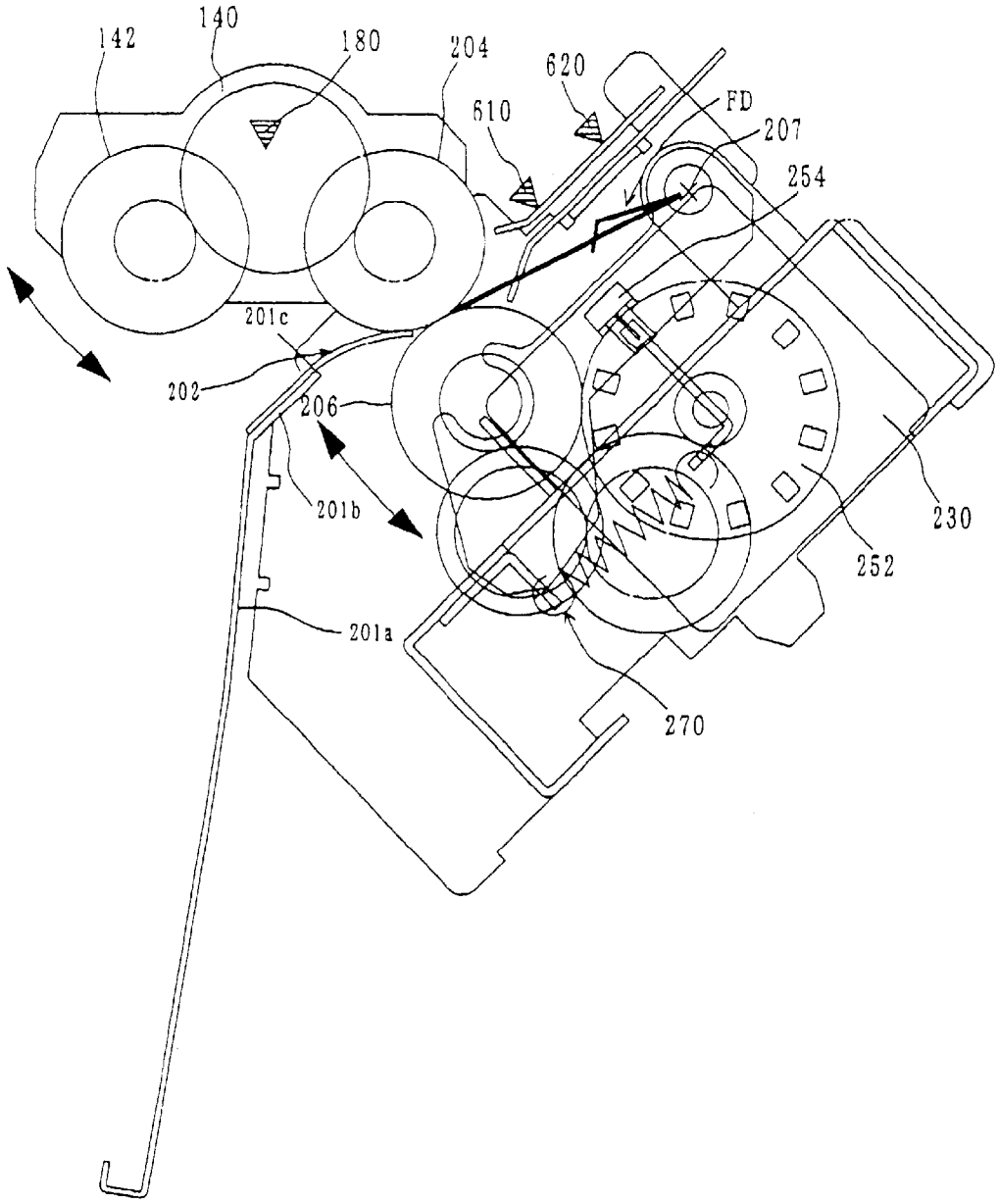
FIG. 8 is a variation of the document feeder shown in FIG. 7.

A description will now be given of an image capture device 1000 as one embodiment of the present invention, with reference to the accompanying drawings. In each figure, those elements that are the same are designated by the same reference numerals, and a duplicated description thereof will be omitted. The image capture device 1000 in the present embodiment is configured as an exemplified scanner that may read out both sheet sides. The image capture device 1000 includes, in a housing 900, a document feeder 100, a conveyor part 300, a pair of reader parts 402 and 404 (hereinafter comprehensively represented by reference numeral '400' for convenience), an ejection part 500, a conveyance detection system 600, an operation part 700, and a controller 800. Hereupon, FIG. 1 is a schematic sectional view from the right hand side of the document feeder 100. FIG. 2 is a schematic sectional view from the left hand side of the document feeder 100. FIG. 3 is a schematic perspective view of the image capture device 1000. FIG. 4 is a schematic plan view of the document feeder 100. FIG. 5 is a plan view of a pick roller unit 140 in the document feeder 100. FIG. 6 is a sectional view of the pick roller unit 140 in the document feeder 100. FIG. 7 is a partially enlarged sectional view of the document feeder 100. FIG. 8 is a variation that embodies a better configuration of a brake roller 206 shown in FIG. 6.

The document feeder 100, which is an ADF as one aspect of the present invention, serves to feed a sheet of paper to be read, to the conveyor part 300. Therefore, the document feeder 100 serves both to feed one or more sheets (i.e., sheet feed function) and to separate one sheet from others (i.e., separation function). The document feeder 100 thus includes a sheet feed mechanism 101 and a sheet separation mechanism 200.

The sheet feed mechanism 101 includes a hopper 110, a hopper driving mechanism 120, a pick roller (pull-in roller) 142, a pick roller driving mechanism 150, and a sensor 180. The pick roller 142 and the separation roller 204 which will be described later are stored in a pick roller unit 140. Optionally provided above the hopper 110 may be a sensor that checks whether the hopper 110 is empty, and/or, a sensor that checks whether the hopper 110 is located at the lowest position. These sensors may be made up of photo-interrupters.

The exemplified hopper 110 is provided at a lower center part of the image capture device 1000 as shown in FIG. 3, and comprised of a hopper table 112 and a pair of guide members 114. The hopper table 112 is a table or tray that supports a stack of sheets LP, and movable (i.e., rotatable in this embodiment) relative to the pick roller 142. Each sheet on the hopper table 112 indicates, for instance, an image to be read out. The guide members 114 are movable in a direction of an arrow A in FIG. 3 on the hopper table 112, guiding the sides of the stacked sheets LP for setup. The guide members 114 may be adjusted to a width of the stacked sheets LP (e.g., A4 size), and configured to be foldable flat if necessary. The hopper driving mechanism 120 adjusts a position of the hopper 110 relative to the pick roller 142.

The hopper driving mechanism 120 drives the hopper 110 to locate the hopper table 112 in position corresponding to an amount of sheets set on the hopper table 112 of the hopper 110. The hopper driving mechanism 120 includes a stepper motor (hopper motor) 122 as a driving source, a gear 124, rollers 126 and 130, a belt 138, sprockets 132 through 135, a guide roller 136, and chains 137 and 139. A driving force is transmitted by the motor 122 through the gear 124 to the roller 130 coaxial with the gear 124, then to the roller 126 and to the sprocket 132 through the belt 138. The driving force transmitted to the roller 126 is transmitted to the coaxial sprocket 134. The chain 137 connects the sprockets 132 and 133 to each other, and the chain 139 connects the sprockets 134 and 135 to each other. Thus, the driving force transmitted to the sprockets 132 and 134 are further transmitted respectively through the chains 137 and 139 to the sprockets 133 and 135, thereby moving the hopper table 112 up and down. The guide roller 136 moves up and down along a track-shaped groove, guiding a movement of the hopper 110.

The hopper 110 is moved up and down and positioned so that the pick roller 142 contacts the topmost sheet among the stacked sheets LP while applying a certain compression force to the stack. The hopper 110 usually moves (pivots or swings) within a certain range under control over operation based upon various sensors, and the document feeder 100 may further include a mechanism for restricting movements of the hopper 110 beyond the range in the event of malfunctions of control and driving systems.

The pick roller 142 is comprised of a pair of rollers at an almost widthwise center part of the hopper 110 above the hopper table 112. Although this embodiment renders the hopper 110 movable up and down, it is sufficient that the hopper 110 and the pick roller 142 move tip and down relative to each other. Such an up-and-down movement need not be perpendicular to a sheet feed direction, but may be replaced with a pivotal (or swinging) movement about an external fulcrum. In feeding a sheet, the pick roller 142 rotates counterclockwise in FIG. 1 (i.e., counterclockwise in FIG. 2), and feeds (one or more) top sheet(s) among the stacked sheets LP to a following stage. The pick roller 142 preferably uses materials selected among those having a high frictional coefficient, such as rubber, so that the pick roller 142 may separate the top sheet(s) from the stacked sheets using a pull-in force larger than frictional and electrostatic forces between stacked sheets.

The pick roller 142, together with the separation roller 204, is stored in the pick roller unit 140. The pick roller unit 140 includes, as illustrated in FIG. 6, a bottom cover 144, a pick height detector 146 and a top cover 148. The pick height detector 146 detects a height in picking-up by shielding light for the sensor 180 that will be described later. As shown in FIG. 6, the top cover 148 and the bottom cover 144 may open and close.

The pick roller 142 is supported swingable around an axis of the separation roller 204, and thus retreatable from a space above the hopper table 112. A pick-roller-unit position regulator (not shown) is provided that may contact the pick roller unit 140 where the pick roller 142 is located at its top position. This pick-roller-unit position regulator projects out, for instance, when the hopper 110 moves down to the lowest position, restricting a movement of the pick roller unit 140, and recedes as soon as the device is booted up, releasing the pick roller unit 140 from the restriction. The pick roller unit 140 and the pick-roller-unit position regulator form a mechanism for retreating the pick roller 142, which automatically retreats, in loading sheets, the pick roller 142 upwardly from the space above the hopper 110, facilitating the sheet loading. When the device is booted up, the pick roller 142 usually drops, unless manually retreated upwardly, by its own weight or by a spring or the like (not shown), down to a proper position so as to contact the top of the stacked sheets LP in the hopper 110.

The pick roller driving mechanism 150 that drives the pick roller 142 to rotate includes, as shown in FIG. 4, a stepper motor (pick motor) 152 as a driving source, a pulley 154 provided on a drive shaft of the motor 152, a belt 155, a pulley 156 about which the belt 155 is entrained to establish connection with the pulley 154, a gear 158 coaxial with the pulley 156, a gear 160 in mesh with the gear 158, a shaft 162 provided with the gear 160, a clutch 164 connected to the shaft 162, and gears 166, 158 and 160 connected to the clutch 164. The gear 170 is fitted onto a shaft 143 shown in FIG. 5 that supports a pair of the pick rollers 142, and connected to the pick roller 142 incorporating a one-way clutch that applies a driving force to a sheet only when the shaft 143 rotates in a sheet feed direction. A rotary direction of the one-way clutch corresponds to the sheet feed direction. These elements transmit the driving force derived from the stepper motor 152 to the pick roller 142. The controller 800 that receives positional information of the hopper 110, as will be described later, controls the electrification to the stepper motor 152.

The sensor 180 checks whether the hopper 110 is located at an adequate position for feeding sheets (i.e., sheet feedable position). In this embodiment, when the hopper 110 is located at the sheet feedable position, the pick roller is also located at a sheet feedable position, and the sensor 180 checks whether the hopper 110 and the pick roller 142 are ready to feed sheets. The sensor 180 includes, for example, a photo-interrupter. When there are few sheets in the hopper 110, the pick roller 142 and the separation roller 204 form an approximately horizontal line, but as the number of sheets increases, a line connecting the pick roller 142 to the separation roller 204 inclines while plunging forward in the sheet feed direction FD. Therefore, the hopper 110 changes its position according to the quantity (number) of sheets. Since the pick roller 142 moves to a position corresponding to a height of the topmost sheet and inclines, the position (height) or orientation of the topmost sheet may be detected by an inclination of the pick roller 130.

The sheet separation mechanism 200 includes a separation gate 201, a separation pad 202, a separation roller 204, a brake roller 206, a separation roller driving mechanism 210, an electromagnetic brake 230, a braking-force transmission mechanism 240, a rotation detector 250, and a forcing member 270. FIGS. 7 and 8 depict arrangements of these elements.

The separation gate 201 is placed between the pick roller 142 and the separation roller 204, adjacent to the hopper 110, and substantially perpendicular to the hopper table 112. The separation gate 201 includes, as shown in FIGS. 1 and 2, a perpendicular portion 201*a* and a bending portion 201*b* that are formed by partially bending a single elastic plate member although they may be provided separately according to the present invention. The separation gate 201 may be configured to move up and down in accordance with the movement of the hopper 110. The separation gate 210 restricts the number of sheets to be fed by the perpendicular portion 201*a*. and allows the topmost sheet to be fed apart from the stack along the bending portion 201*b*. The separation gate 201 performs a preparatory separation process by the separation pad 202 and the separation roller 204, permitting multistage sheet separations.

The separation gate 201 separates the sheets by restricting the number of sheets to be fed that the pick roller 142 pulls in, and the number of sheets to be fed may be controlled by controlling a position of the separation gate 201 and that of the pick roller 142. As shown in FIG. 7, relative positions (in the height direction) of the top end portion 201*c* of the bending portion 201*b* of the separation gate 201 and the lower portion 131 of the pull-in roller 130 are determined so that the top end portion 201*c* may be level with or preferably a little higher than the lower portion 131 in order to achieve a predetermined sheet separation performance (i.e., to allow one or a few sheets P among the stacked sheets on the hopper table 112 to be fed).

Without the separation gate 201, the separation roller 204 and the separation pad 202 cannot properly separate sheets P, thereby possibly causing jamming and double feeding. However, the separation gate 201 in this embodiment separates (and feeds) only one or a few top sheets, solving this problem.

Moreover, the separation gate 201 improves user's operability in setting the sheets in the hopper 110, and increases feed reliability. To be specific, a user sets the sheets P in the hopper 110 by touching the edges of the stacked sheets LP to the perpendicular portion 201*a* of the separation gate 201. Without the separation gate 201, the edges of the stacked papers LP would incline and fail to align neatly. Then a sheet in the stack is set in a position apart from the pick roller 142 cannot be fed. When a user strongly pushes the sheets P inside to align their sheet edges, some sheets would be inserted between the separation roller 204 and the separation pad 202, causing jamming and double feeding. In contrast, a user in this embodiment sets the sheets by touching them to the separation gate 201, ensuring a reliable feed by the pick roller 142.

Figure 32:
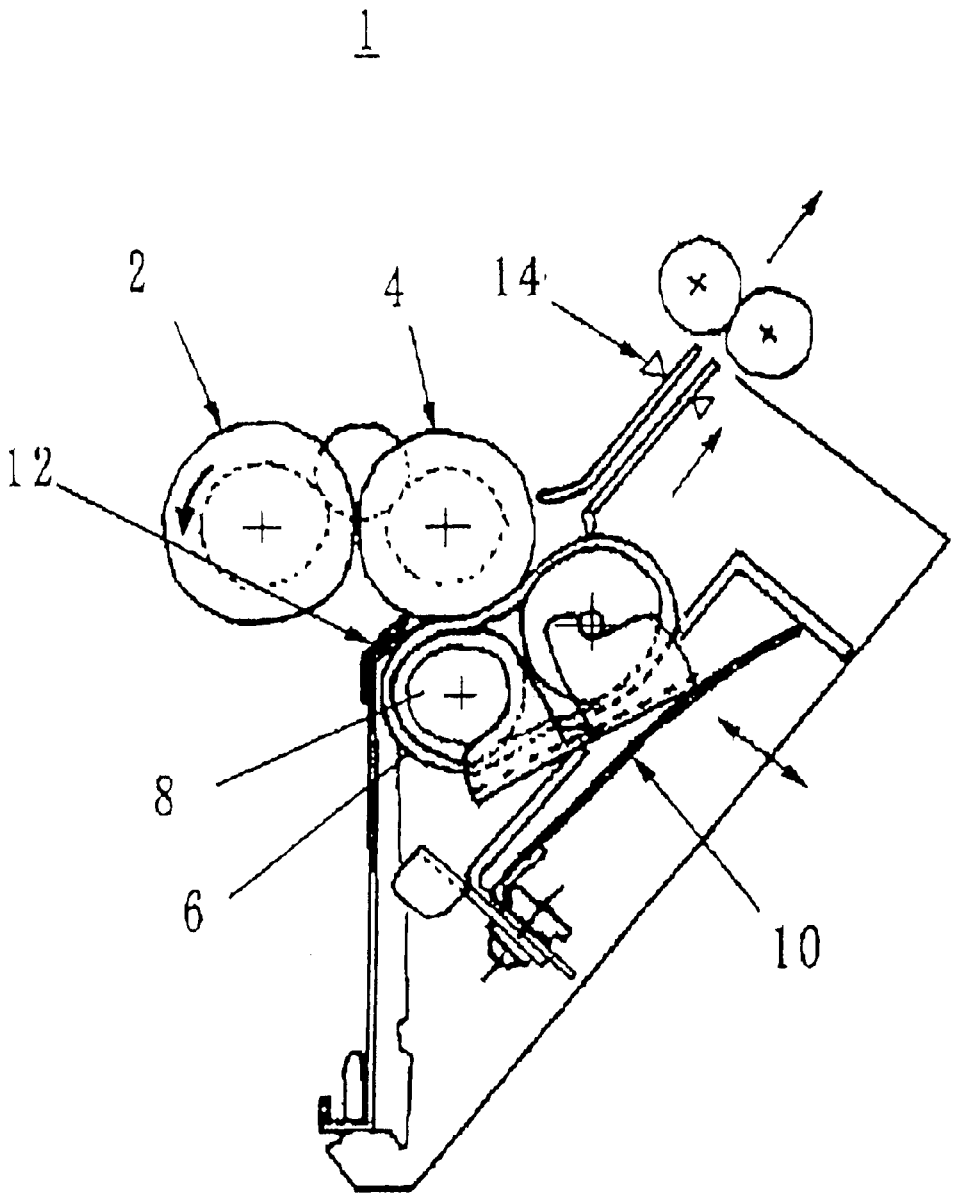
FIG. 32 PRIOR ART
FIG. 32 is a schematic sectional view of principal part of a conventional document feeder.

A separation portion at the next stage includes the separation pad 202, the separation roller 204 and the brake roller 206. The brake roller 206 may be replaced with a belt 6 shown in FIG. 32. The separation pad 202, the separation roller 204, and the brake roller 206 may be made of resin rollers and pads each having a high frictional coefficient, so as to separate one sheet from more than one sheets P (i.e., sheet P that contacts the separation roller 204) and feed the same in the feed direction. If a frictional force between the separation pad 202 and the separation roller 204, and that between the separation roller 204 and the brake roller 206 are too weak, the sheet P cannot be separated. Thus, they are adjusted preferably as follows: Static frictional force between each sheet<Frictional force between a sheet and the separation pad 202; Frictional force between a sheet and the brake roller 206<Sheet feed force by a pick roller 142 and/or the separation roller 204. A further description thereof will be given later.

It appears that this relationship indicates that a sheet separation performance becomes improved as sheet feed forces by the pick roller 142 and/or separation roller 204 are primarily increased, but actually the excessively large sheet feed force by the pick roller 142 might disadvantageously break a sheet. In addition, the static frictional force between sheets varies considerably with a property of a sheet in use, so it is difficult to establish a specific relationship. Further, since a variety of sheets including a special paper, such as NCR, are used with a scanner, the separation pad 202 is preferably made of materials (e.g., urethane) resistant to a chemical reaction by pressure.

The separation roller driving mechanism 210 that drives the separation roller 204 to rotate includes, as shown in FIG. 4, a stepper motor (separation motor) 212 as a driving source, a roller 214 provided on a drive shaft of the motor 212, a belt 216, a roller 218 about which the belt 216 is entrained to establish connection with the roller 214, a gear 220 coaxial with the roller 218, a gear 222 in mesh with the gear 220, and a shaft provided with the gear 222. The shaft 224 incorporates a one-way clutch that applies a driving force to a sheet only when the separation roller 204 rotates in the sheet feed direction as shown in FIG. 4. These elements transmit the driving force derived from the stepper motor 212 to the separation roller 204. The controller 800 controls the electrification to the stepper motor 212.

Figure 16:
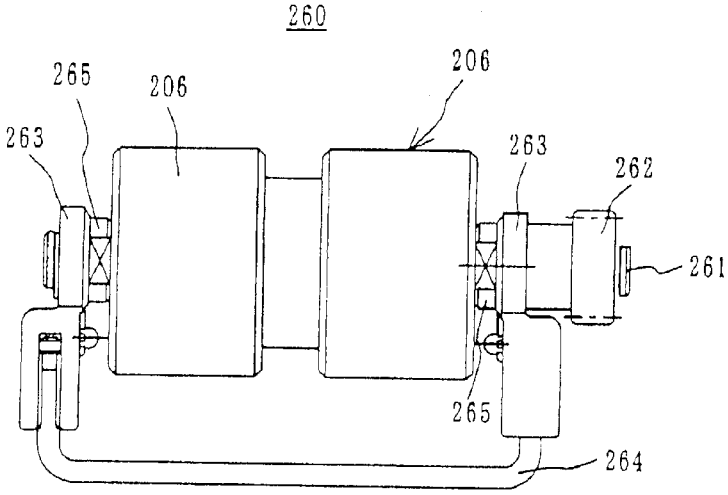
FIG. 16 is a schematic plan view of a brake roller unit applicable to the document feeder shown in FIG. 1.

The brake roller 206 is comprised of a pair of rollers placed opposite to the separation roller 204 below the separation roller 204. The separation roller 204 and the brake roller 206 define a sheet feed path between each other. The brake roller 204 is a driven element, while the separation roller 204 driven by the motor 212 is a driving element. However, the present invention allows the brake roller to be a driving element. The brake roller 206 is, as shown in FIG. 16, independent of the electromagnetic brake 230, and configured to be part of a brake roller unit 260 that can be replaced easily. The brake roller 206 preferably turns around a pivotal fulcrum 207 as will be described later with reference to FIGS. 8 and 17. FIG. 16 is a schematic plan view of the brake roller unit 260.

The brake roller unit 260 includes, as shown in FIG. 16, a pair of brake rollers 206, a shaft 261, a gear 262, a lever 264, and a connector 265. The brake roller 206 is integrally molded with the shaft 261, and the gear 262 is fixed onto the shaft 261. Consequently, as the brake roller 206 rotates, the gear 262 rotates, too. The gear 262 is meshed with the gear 246 in the braking-force transmission mechanism 240, and receives a braking force. The braking force that has been transmitted to the gear 262 is transmitted from the gear 262 to the shaft 261, braking the rotating brake roller 206. The lever 264 is connected to the shaft 261 through an engagement portion 263. The engagement portion 263 includes a bearing that allows the shaft 261 to rotate. A user can easily replace the brake roller unit 260 by lifting the lever 264. Each connector 265 is located between the paired engagement portion 263 and brake roller 206. The connector 265 is a portion that is detachably fitted in the document feeder 100 as will be described later.

Figure 17:
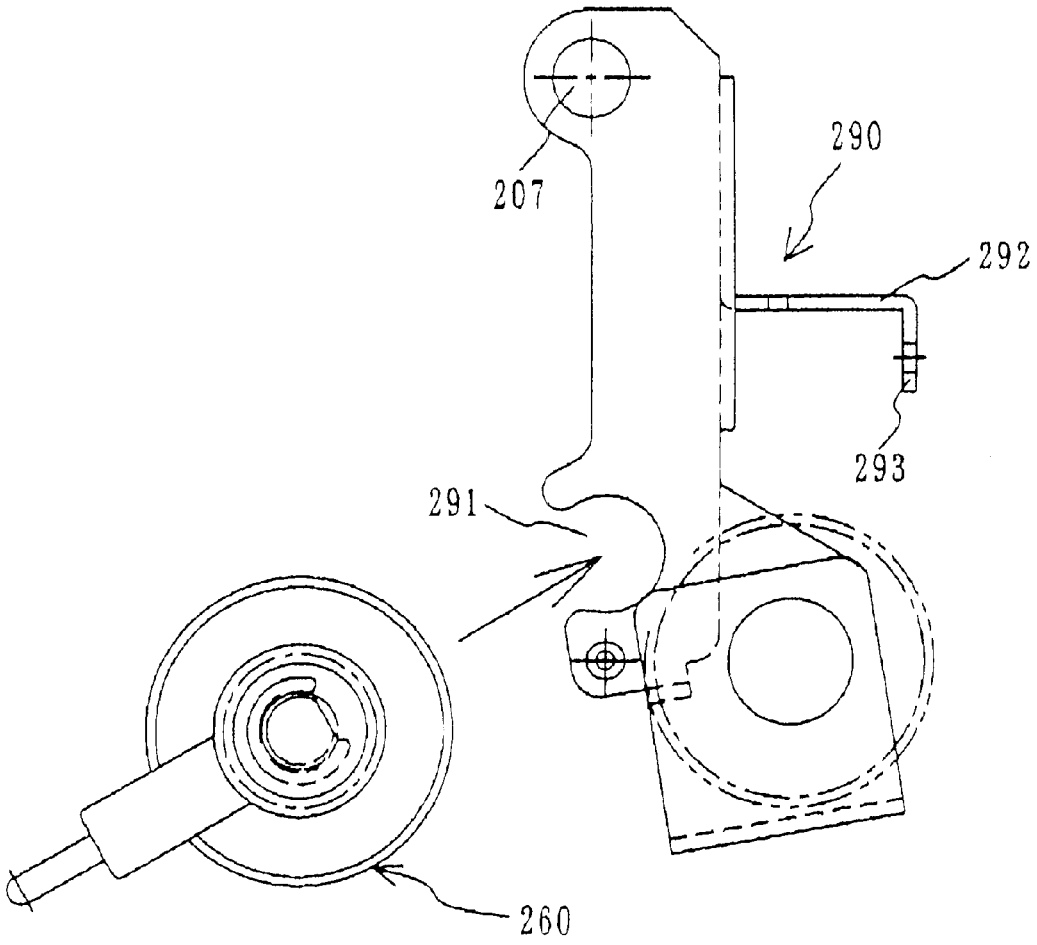
FIG. 17, which corresponds to FIG. 8, is a schematic side view for explaining removable mounting of the brake roller unit shown in FIG. 14 onto the document feeder shown in FIG. 1.

The new brake roller unit 260 can be fitted into the document feeder 100 as shown in FIG. 17. FIG. 17, of which a structure corresponds to the embodiment shown in FIG. 8, is a schematic side view for explaining the mounting into and demounting from a swinging portion 290 of the brake roller unit 260. The pivotal fulcrum 207 is located around a line extending from a sheet feed path defined by the separation roller 204 and the brake roller 206, and serves to regulate Ps's fluctuation.

Figure 18:
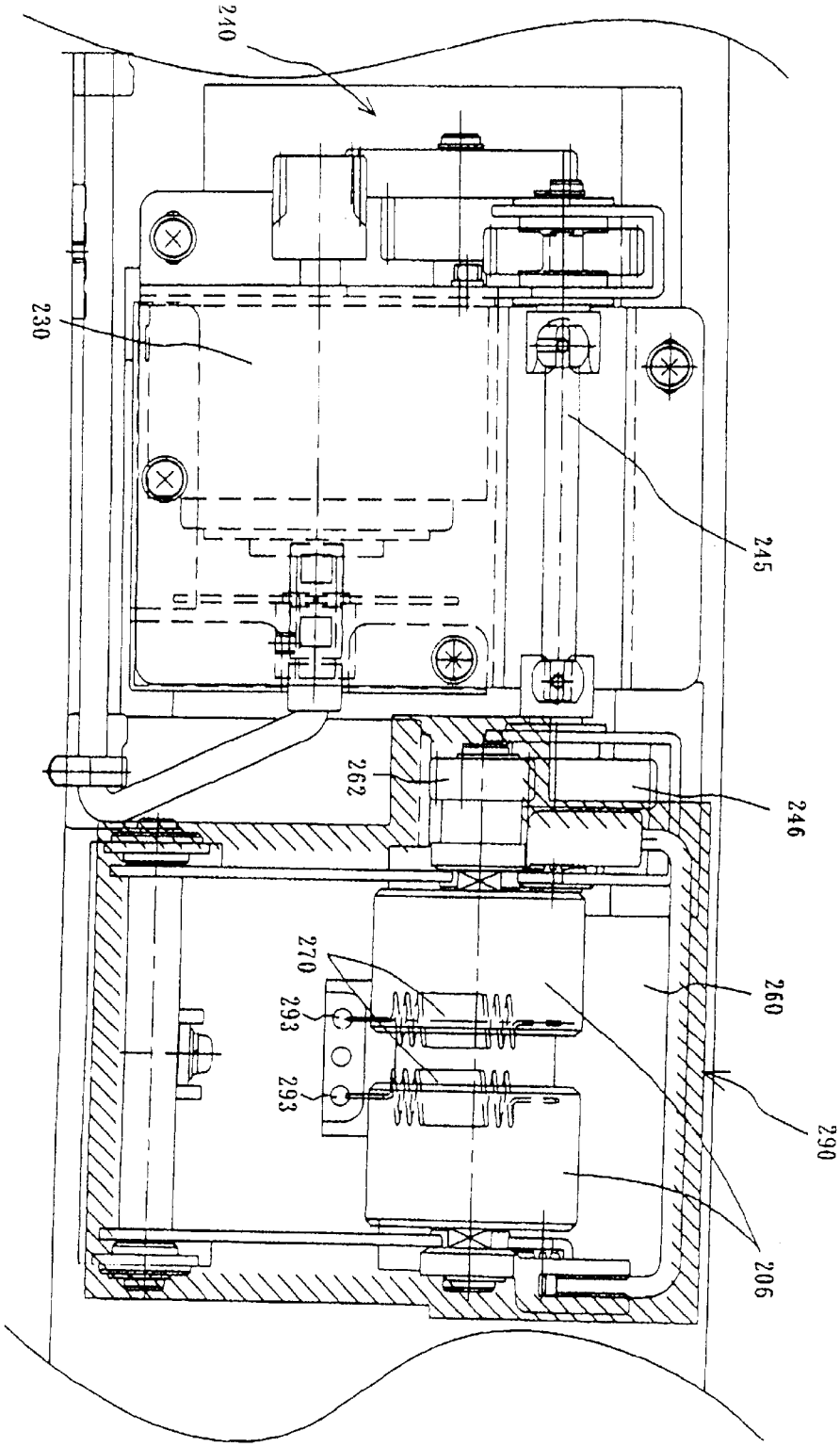
FIG. 18 is a plan view of a document feeder mounted with the brake roller.
Figure 19:
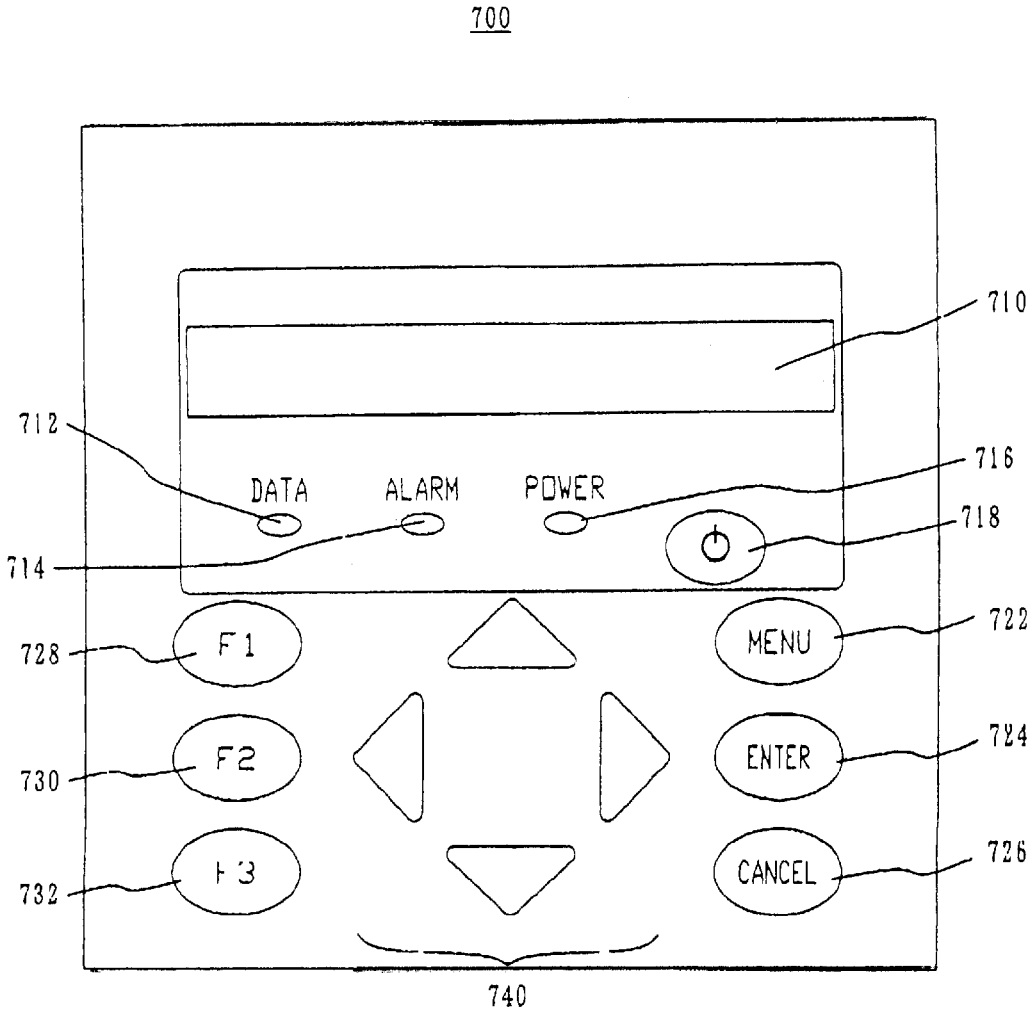
FIG. 19 is a plan view of an operator panel in the image capture device shown in FIG. 5.

The swinging portion 290 is shaded in FIG. 18, and coupled with the document feeder 100 rotatable around the fulcrum 207. FIG. 18 is a plan view of the document feeder 100 in which the brake roller unit 260 is fitted into the swinging portion 290. The swinging portion 290 includes a pair of engagement holes 291 connectible with the connector 265, and an L-shaped engagement portion 292. The shaped engagement portion 292 exemplarily includes, as illustrated in FIGS. 17 and 18, three engagement holes 293 engageable with one end of the forcing member 270 in this embodiment. As will be described later, the other end of the forcing member 270 is connected with a frame (not shown) in the document feeder 100, and the swinging portion 290 presses the brake roller unit 260 toward the separation roller 204 through the connector 265. In other words, the brake roller unit 260 as well as the swinging portion 290 can turn around the fulcrum 207. Since the brake roller unit 260 is rotatable around the fulcrum 207, the braking-force transmission mechanism 240 is comprised of a universal joint that will be described later.

Figure 33:
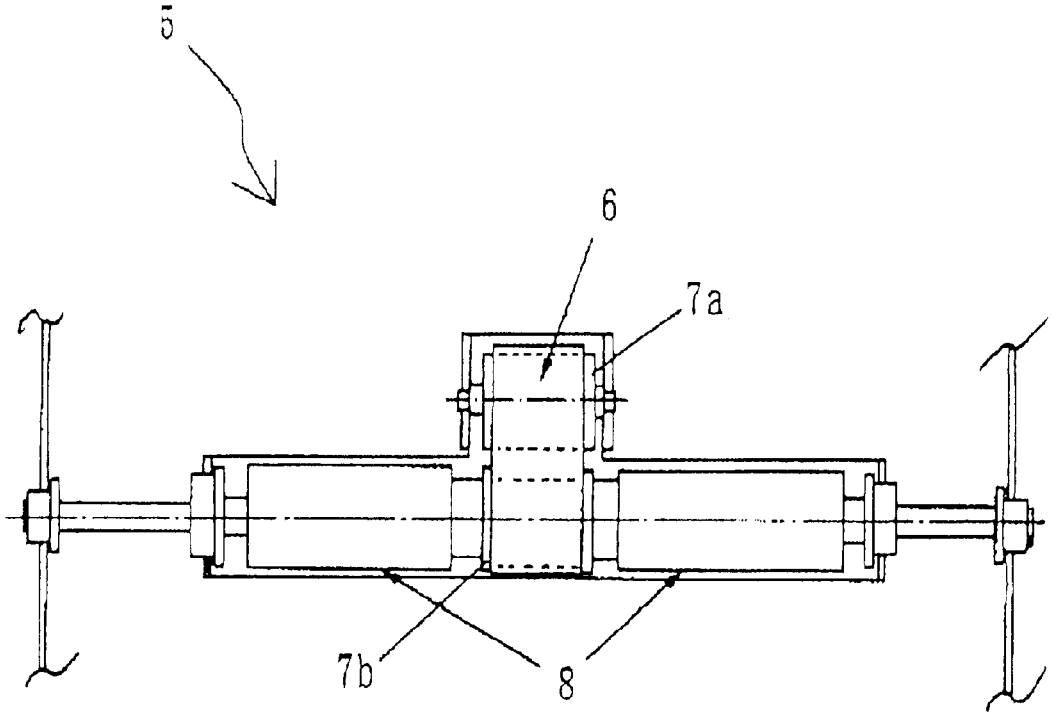
FIG. 33 PRIOR ART
FIG. 33 is a schematic front view of a separation belt unit in the document feeder shown in FIG. 32.

The electromagnetic brake 230 in this embodiment is embodied as a non-excitation disc type electromagnetic brake as in FIGS. 9 to 13 inclusive, but it is to be understood that the present invention places no limitation on the types of braking means. Although the torque limiter 8 is consumable as well as the separation belt 6 in the prior art shown in FIG. 33, the electromagnetic brake 230 in this embodiment has a semipermanent lifetime, and thus the present invention considerably economically improves the document feeder 100. Characteristically, the electromagnetic brake 230 can apply a variable braking force to the brake roller 206 (under control of the controller 800 that will be described later). The electromagnetic brake 230 typically includes a rotation axis 232, a rotor (not shown) provided near the center of the rotation axis 232 rotatable with the rotation axis 232, a pair of fixing plates that sandwich a top and bottom of the rotor, and an armature located between one fixing plate (that will be referred to as 'stator' for convenience) and the rotor. The armature is so actuated as to press the rotor toward the fixing plate, for instance, by a braking spring (such as a coil spring) provided on the stator. The stator has a coil. The electrification through the coil produces an electromagnetic force, and the armature contacts the stator against the coil spring force, releasing the rotor. On the other hand, when the electrification the coil is turned off, the armature presses the rotor against the fixing plate by the coil spring force, and applying a braking force to the rotor. As a result the rotor is damped between the armature and the fixing plate, and the braking force is applied to the rotation axis 232.

The above electromagnetic brake 230 exhibits an exemplary configuration. For instance, the electromagnetic brake 230 may include some armatures and/or electromagnets to produce multistage braking forces. As another example of the electromagnetic brake is a non-contact brake of 'pure electromagnetic coupling type' which generates a torque only by a pure electromagnetic force. The rotor incorporates a magnetizing coil. A cup as an output side forms a magnetic pole between internal and external poles of the rotor with a specific gap, and is supported in a ball bearing. The electrification to the magnetizing coil produces a magnetic field in the gap between the internal and external poles of the rotor. Accordingly, the cup (a permanent magnet member) placed in the gap (or magnetic field) is magnetized, too. However, a magnetic change in the permanent magnet member having a hysteretic property is lagged behind a polarity change in the magnetic pole, and thus the rotor and the cup are magnetically coupled with each other.

The electromagnetic brake 230 may be replaced with other braking means. The controller 800 in FIG. 1 controls a braking force of the electromagnetic brake 230 (i.e., the electrification to the coil in the electromagnetic brake 230). As discussed later, the controller 800 controls the electromagnetic brake 230 so that the electromagnetic brake 230 may apply the variable braking force to the brake roller 206.

The braking-force transmission mechanism 240 includes various sized gears (241 through 244 and 246) and a linkage 245. The gear 241 connected with the electromagnetic brake 230 is connected with the gear 242, the gear 242 is connected with the gear 243 through a shaft (not shown), and the gear 243 is meshed with the gear 244. The gear 244 is connected with the gear 246 through the linkage 245, and the gear 246 is connected with the gear 262 of the brake roller unit 260. Therefore, the braking-force transmission mechanism 240 transmits the braking force from the electromagnetic brake 230 to the gear 262. The linkage 245 of this embodiment exemplarily uses a universal joint exhibiting little fluctuation in separation load Ps, and having a spherical member at both ends, and may swing to 360 degrees. The linkage 245 is however not limited to the universal joint, but may use other joints such as a cylindrical joint, screw joint, plane joint, spherical joint, point curve joint, point slice joint.

Figure 9:
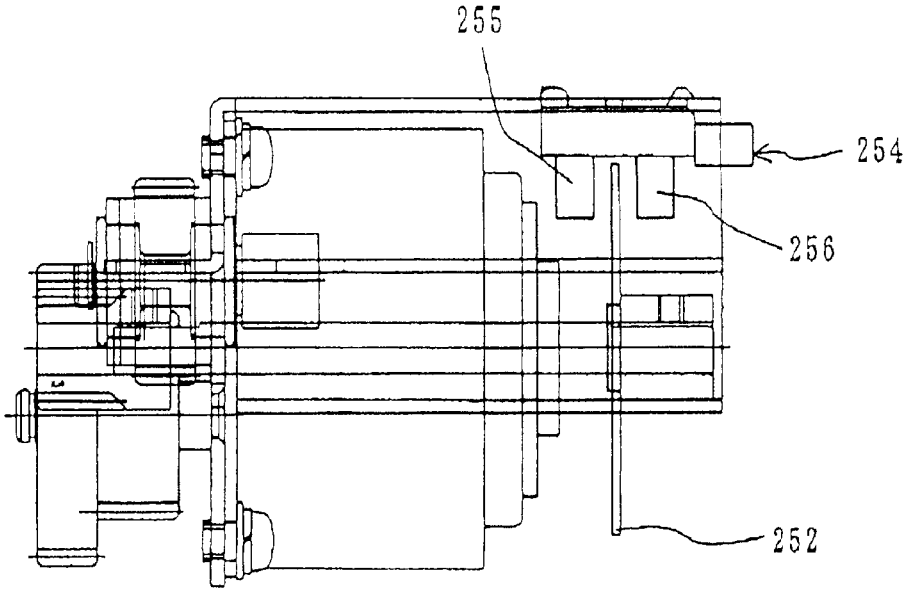
FIG. 9 is a side view of an electromagnetic brake and a rotation detector in the document feeder shown in FIG. 1.
Figure 10:
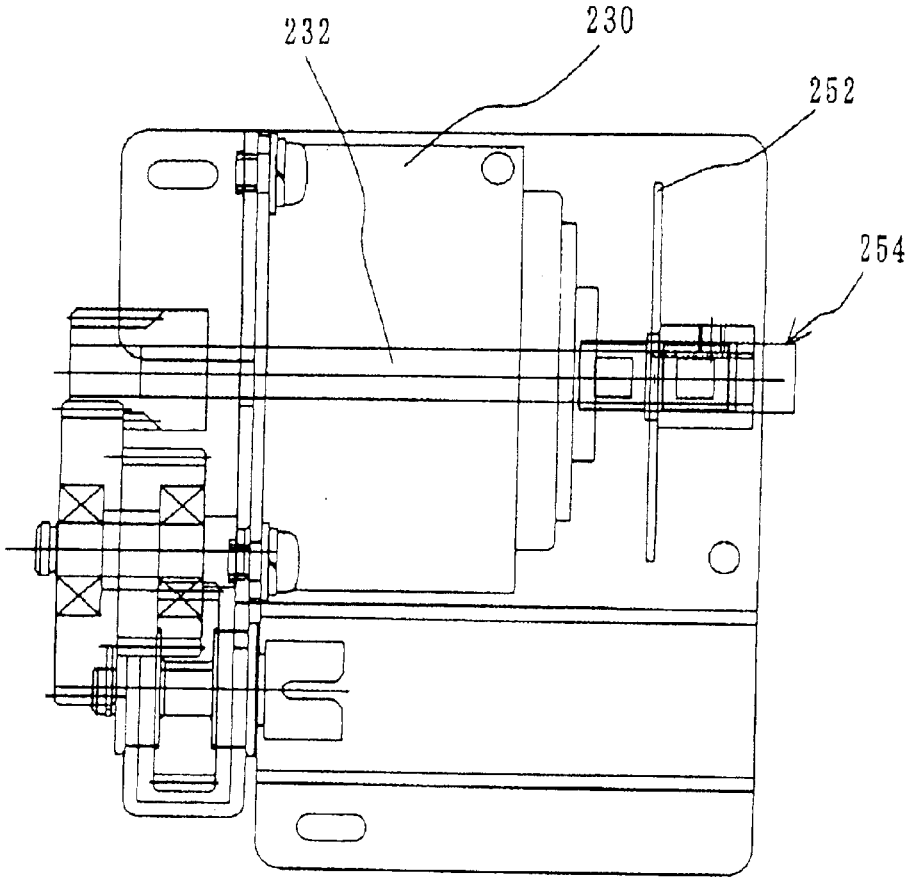
FIG. 10 is a plan view of the electromagnetic brake shown in FIG. 7.
Figure 11:
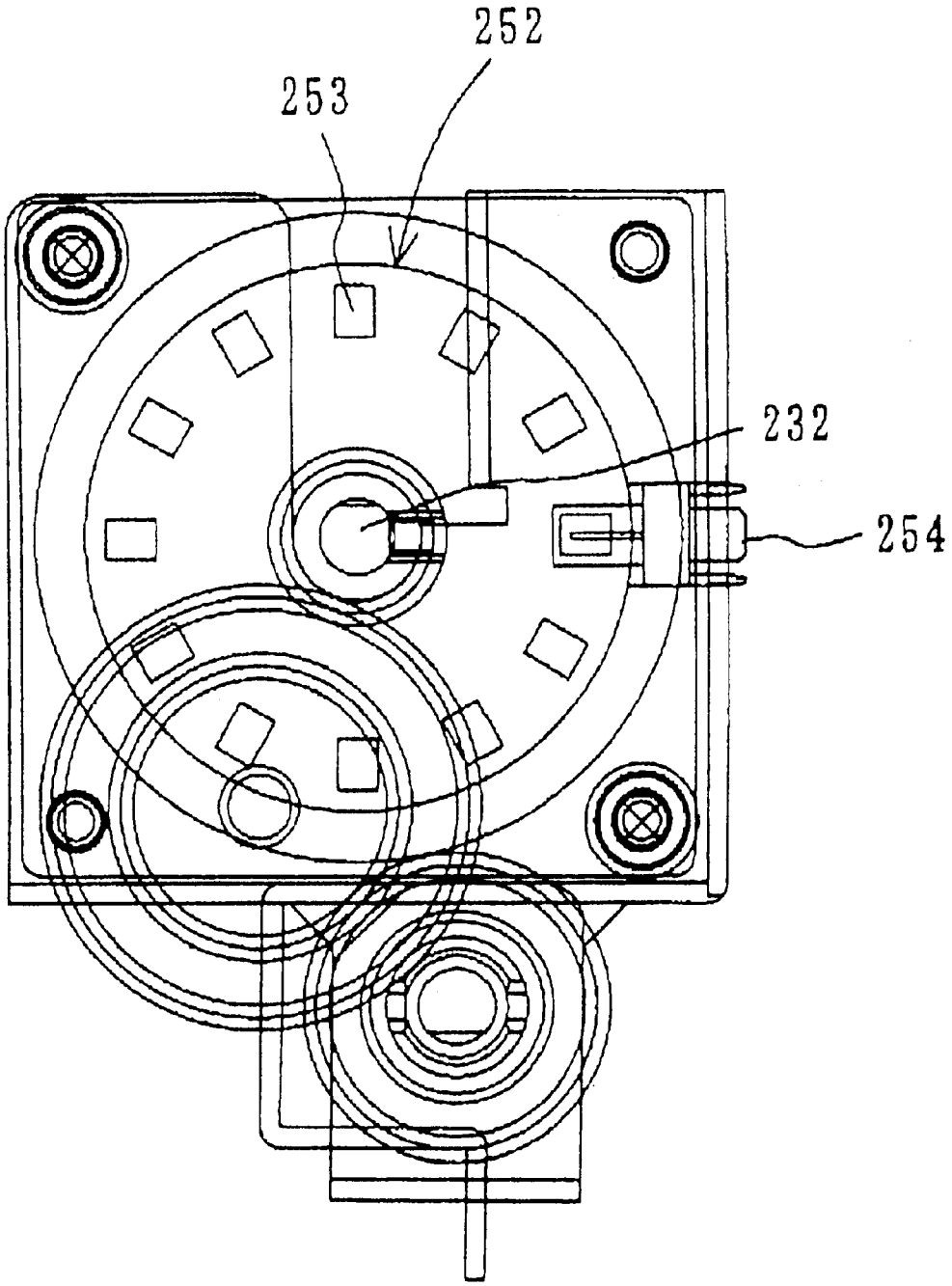
FIG. 11 is a front view of the electromagnetic brake shown in FIG. 7.
Figure 12:
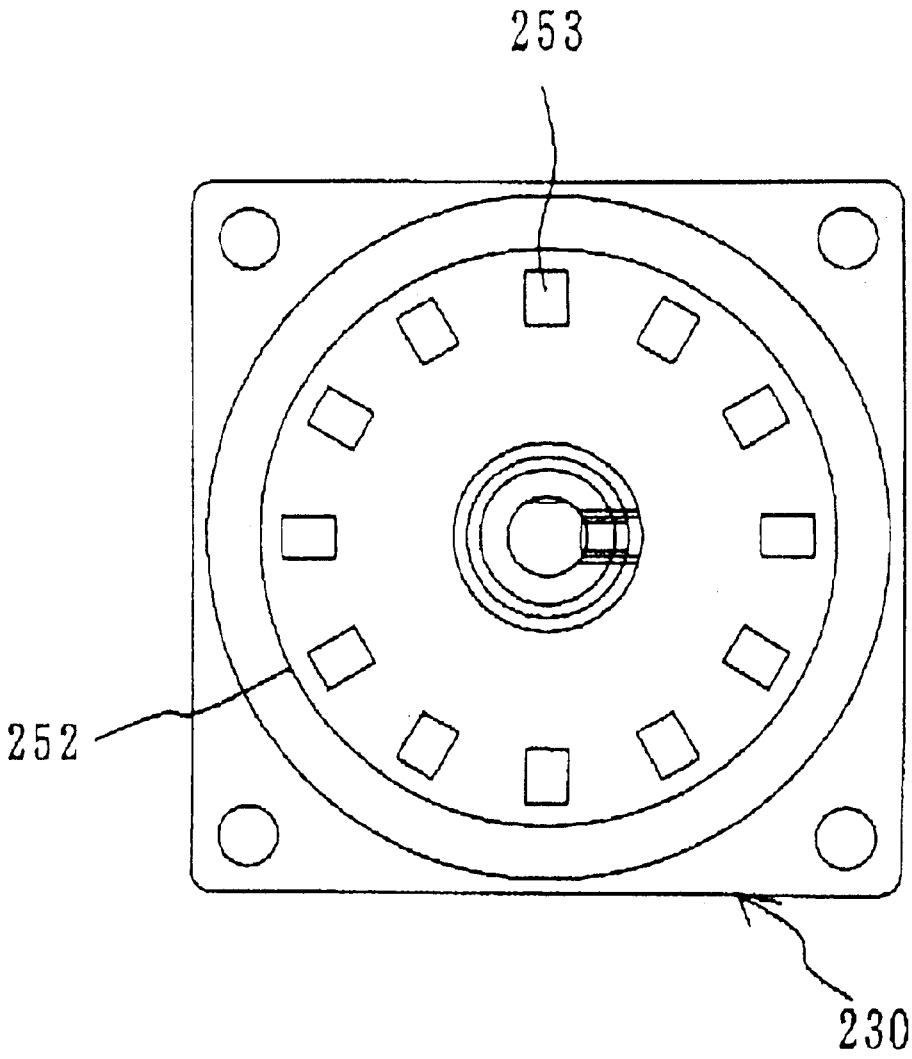
FIG. 12 is a front view of the electromagnetic brake and rotation detector shown in FIG. 7.
Figure 13:
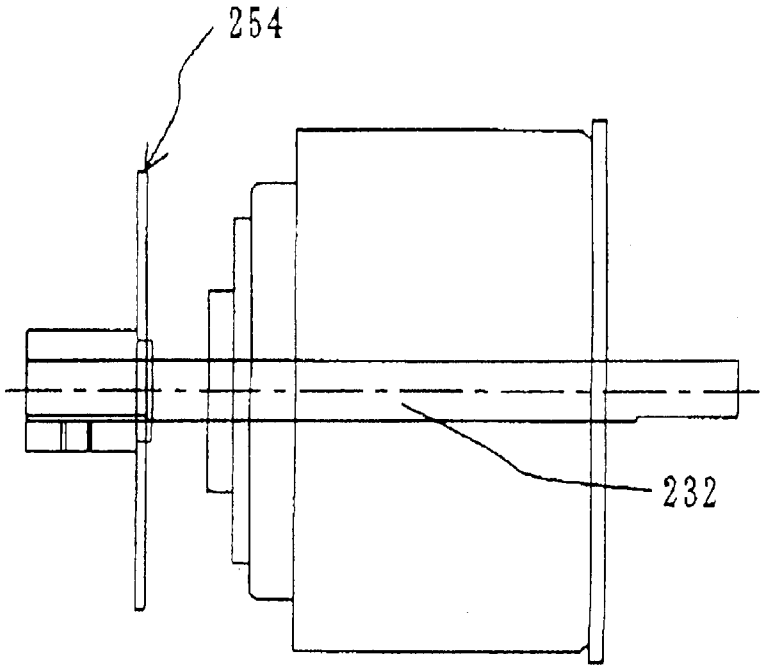
FIG. 13 is a schematic sectional view of the electromagnetic brake and rotation detector shown in FIG. 10.

The rotation detector 250 includes an encoder 252 and a sensor 254. The encoder 252 is comprised, as shown in FIGS. 11 and 12, of a plurality of holes or slits 253 arranged at a regular interval, connected with the rotation axis 232 of the electromagnetic brake 230 rotatable with it. The slits may be printed on a transparent film. The sensor 254 includes, but not limited to, an optical sensor comprised of a light-emitting element 255 and a light-receiving element 256 as shown in FIG. 9 in this embodiment. A ray emitted from the light-emitting element 255 such as a light-emitting diode in the sensor 254 comes through the slits 253 on the encoder 252 into the light-receiving element 256 such as a photo IC, and then is converted into a digital signal. The number of revolutions of the rotation axis 232 of the electromagnetic brake 230 can be detected from the light interval received by the light-receiving element 256. Since the slits 253 on the encoder 252 are arranged at a regular interval, an output of the sensor 254 may be represented in an analogue fashion as shown in an upper portion in FIG. 26.

The forcing member 270 presses the brake roller 206 (or the brake roller unit 260) toward the separation roller 204. To be more specific, the forcing member 270 presses the swinging portion 290, thereby pressing the brake roller 206 toward the separation roller 204. The forcing member 270 is, though schematically shown in FIG. 4, configured, for example, as a pair of compression springs as shown in FIG. 18. In this embodiment, one end of the compression spring is connected to the engagement hole 293 on the swinging portion 290, and the other end is connected to a frame (not shown) in the document feeder 100. Alternatively, the compression spring is fixed in the image capture device 1000 at one end, and connected to the brake roller 206 (or the brake roller unit 260) at the other end.

Figure 14:
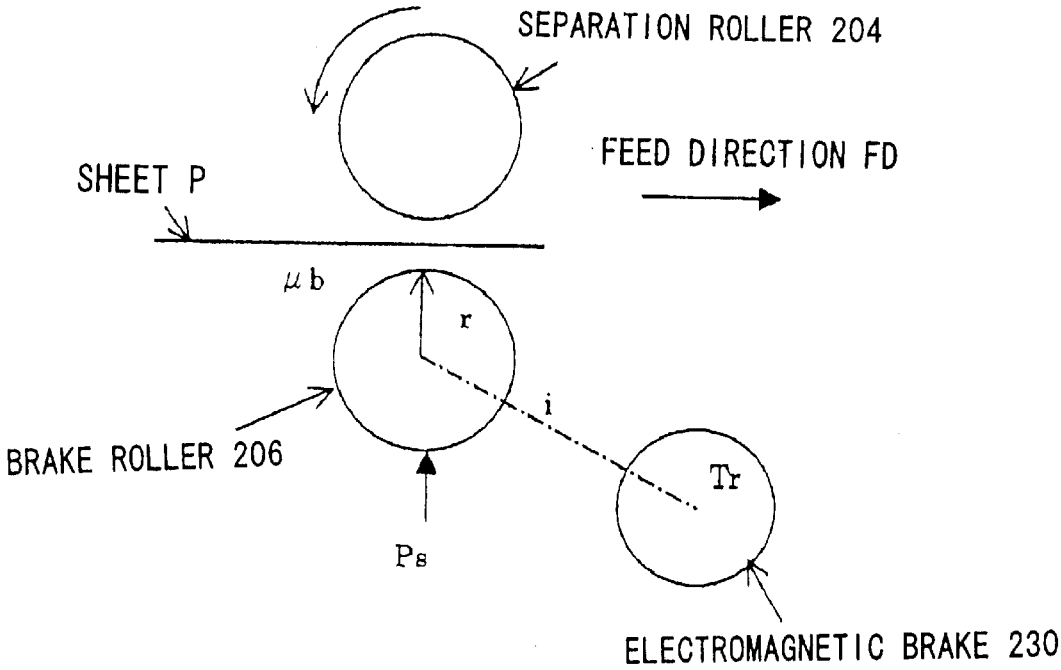
FIG. 14 is a schematic sectional view for explaining a mechanism when one sheet is fed between a separation roller and a brake roller of the document feeder shown in FIG. 1.
Figure 15:
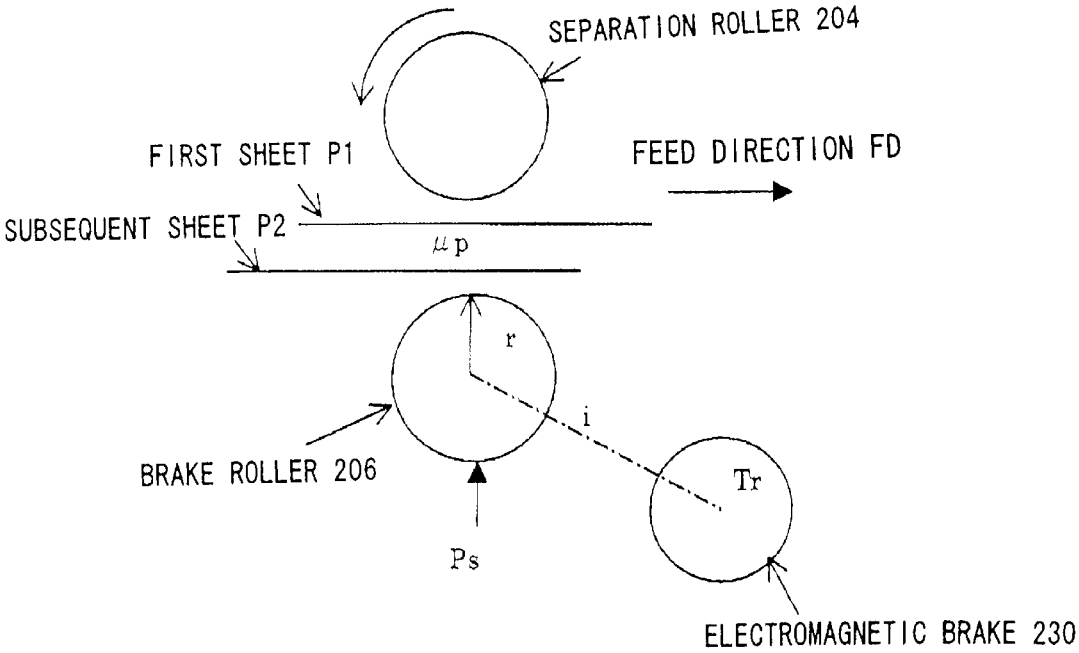
FIG. 15 is a schematic sectional view for explaining a mechanism when two sheets are led between a separation roller and a brake roller of the document feeder shown in FIG. 1.

Referring now to FIGS. 14 and 15, a description will be given of how the electromagnetic brake 230 should control a brake torque Tr, by using the compression force which the forcing member 270 applies (hereinafter referred to as 'separation load Ps'), the brake torque Tr which the electromagnetic brake 230 applies, a reduction rate i from the electromagnetic brake 230 to the brake roller 206 by the braking-force transmission mechanism 240, and a radius r of the brake roller 206. Hereupon, FIG. 14 is a schematic sectional view for explaining a mechanism when a sheet P is fed between the separation roller 204 and brake roller 206 in the document feeder 100. FIG. 15 is a schematic sectional view for explaining a mechanism when two sheets are fed between the separation roller 204 and brake roller 206 in the document feeder 100.

As shown in FIG. 14, the electromagnetic torque Tr generated by the electromagnetic brake 230 is reduced during a transmission to the brake roller 206, and thus the brake roller 206 undergoes a brake torque Tr×i. As a result, a driving force for driving the brake roller 206 becomes Tr×i/r. On the other hand, where suppose that a coefficient of friction between a sheet P and the brake roller 206 is $\mu b$, a force which the sheet P applies to the brake roller 206 becomes $\mu b \times Ps$. A relationship $Tr \times i/r < \mu b \times Ps$ is required in order to properly feed the sheet P in the sheet feed direction FD. The inverse relationship would feed no sheet, or cause feed troubles since any fed sheet partially shaves a surface of the brake roller 206.

As shown in FIG. 15, the brake roller 206 receives the brake torque Tr×i from the electromagnetic brake 230 as in FIG. 14, and thus a driving force for driving the brake roller 206 becomes Tr×i/r. Where suppose that a coefficient of friction between two sheets P1 and P2 is $\mu p$, a force which the sheet P2 applies to the brake roller 206 becomes $\mu p \times Ps$. Thus, in order for the brake roller 206 to feed no sheet P2 in the sheet feed direction FD, $Tr \times i/r > \mu p \times Ps$ is required.

Preferably, the sheet separation mechanism 200 of this embodiment includes several means for restricting a fluctuation of the separation load Ps. First, as shown in FIG. 8, the separation roller 204 and the brake roller 206 create the sheet feed path between them and the fluctuation of the separation load Ps may be minimized by aligning the sheet feed direction FD with the pivotal fulcrum 207. In addition, a universal joint 245 exhibiting little fluctuation in separation load may exemplarily be used for the braking-force transmission mechanism 240 that transmits a braking force from the electromagnetic brake 230.

The conveyor part 300 includes a sheet feed path 310 that conveys a sheet fed from the sheet separation mechanism 200 of the document feeder 100, conveyor rollers 320 (and 321–328) arranged along the sheet feed path 310, driven rollers 330 (331–338) that correspond to the conveyor rollers 320, and a roller driving device 340 that drives the conveyor rollers 320.

The sheet feed path 310 comprises an inclined feed path 312 that conveys a sheet fed from the sheet separation mechanism 200 in an inclined state, and an inversion feed path 314 that follows the inclined feed path 312 for turning over a sheet. Accordingly, a sheet is horizontally placed on the hopper 110 in the hopper 110, inclined in the inclined feed path, then inversed in the inversion feed path 314, and finally ejected to the ejection part 500. Therefore, a face-up sheet in the hopper 110 faces down in the ejection part 500, and the order of the stacked sheets LP in the hopper 110 does not change in the ejection part 500. A plurality of conveyor rollers 321–327 and driven rollers 331–337 are spaced out at a distance shorter than a length of a sheet to be conveyed by the device, as illustrated.

As shown in FIG. 2, the roller driving device 340 includes a conveyor motor 341, a roller 342 provided on a drive shaft (not shown) of the conveyor motor 341, a roller 343 coaxial with the conveyor roller 324, a belt 344 which is entrained about the rollers 342 and 343, a timing belt 350, and various types of rollers 351–359 about which the timing belt 350 is entrained.

A driving force of the motor 341 is transmitted from the roller 342 to the roller 343 through the belt 344, and then to the roller 355 through a shaft (not shown) that supports the roller 343. The driving force transmitted to the roller 355 is transmitted to the various types of the rollers 351–359 through the timing belt 350, and respectively drives corresponding conveyor rollers 321–327 coaxial with the various types of rollers 351–359. The rollers 353 and 356 are tension rollers that apply a proper tension to the timing belt 350. Each conveyor roller 320 rotates counterclockwise in FIG. 1 or clockwise in FIG. 2, so that the sheet may be conveyed in the sheet feed direction FD.

Figure 20:
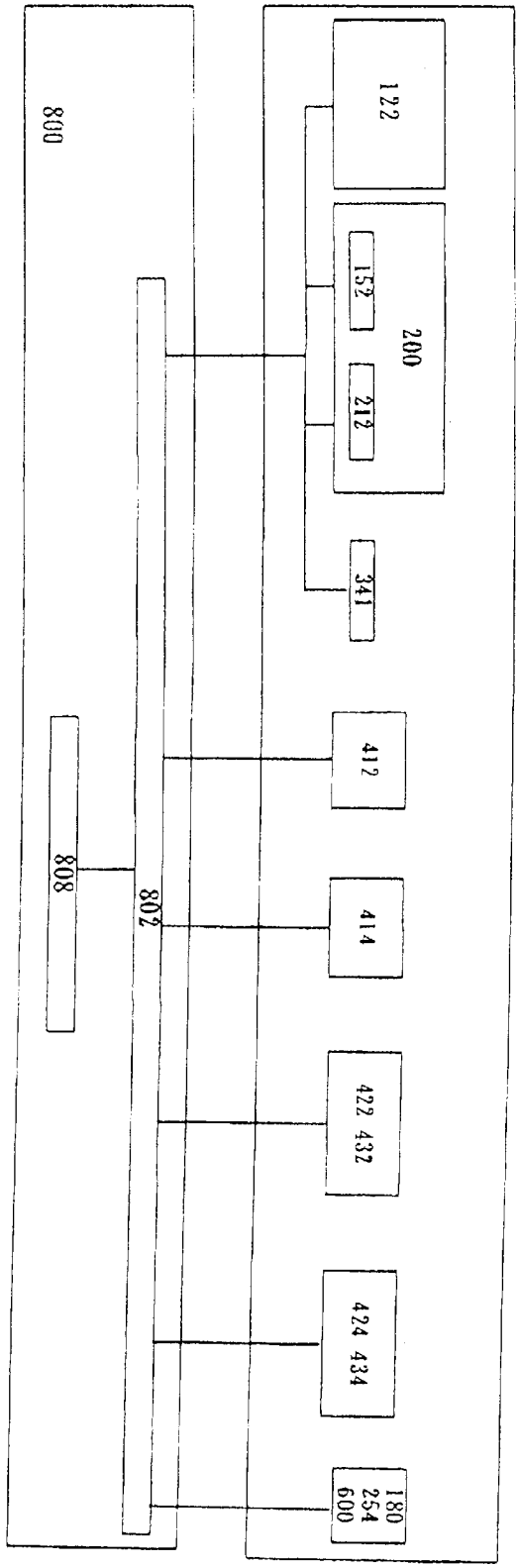
FIG. 20 is a block dia gram of the image capture device shown in FIG. 16.
Figure 21:
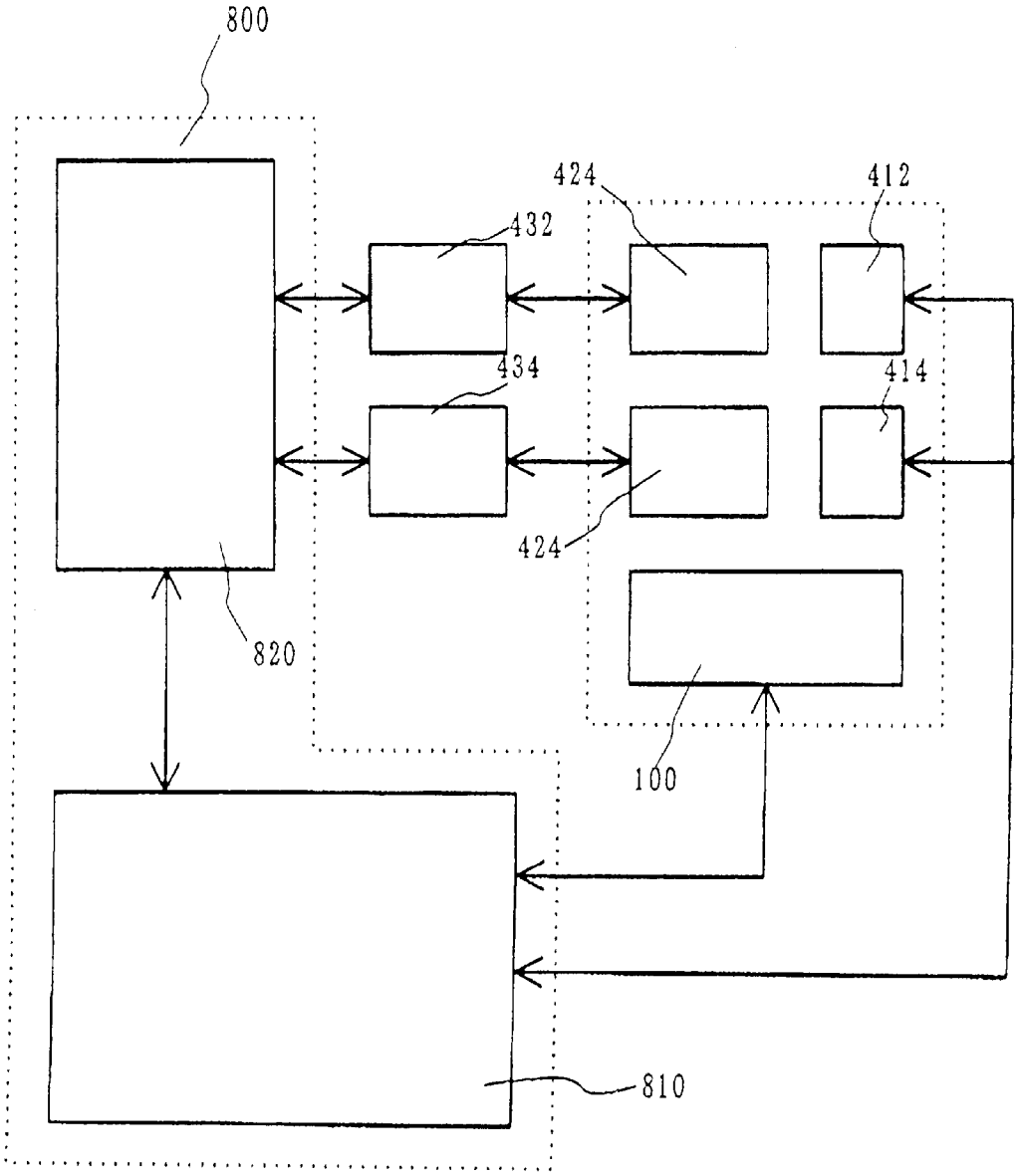
FIG. 21 is a block diagram of a controller in the image capture device shown in FIG. 16.

The reader part 400 is configured as an optical image capture unit that arranges a capture spot on the inclined feed path 312 to optically read out information on a sheet. The reader parts 402 and 404 are both provided at some midpoint on the inclined feed path 312, allowing the reader part 402 to read sheet's front side, and the reader part 404 to read sheet's back side. The reader part 400 typically includes a light source (and inverters 412 and 414 for driving the light source as shown in FIGS. 20 and 21), various types of mirrors, a shading plate that corrects a shading of edges susceptible to image distortion, a lens, CCDs (CCD boards) 422 and 424 that read out a sheet, and video boards 432 and 434 that process information from the CCDs. Any configuration known in the art may be used for the reader part 400, and thus a detailed description of its structure and operation, etc. will be omitted.

A sheet read by the reader part 400 is ejected from the conveyor part 300 to the ejection part 500. As shown in FIG. 3, the ejection part 500 is located above the image capture device 1000. To be more specific, the ejection part 500 optionally includes a stacker table 510, a frame 520, and a latch mechanism 530, as shown in FIGS. 1 and 2. The latch mechanism 530 permits a downward movement of the stacker table 510, but does not permit its upward movement unless unlocked. As a stacker surface is manually pressed down, the stacker table 510 falls down and the latch mechanism 530 holds the stacker table 510 in position. If the lock of the latch mechanism 530 is released, the stacker table 510 returns to the highest position. This configuration allows a single operation to move down and hold the stacker table 510.

The conveyance detection system 600 includes various types of sensors 610–640 that are disposed near along the feed path 310. The sensor 610 detects a top of a sheet, and the sensor 620 detects a thickness of the sheet. The sensor 620 detects the sheet thickness and the number of sheets by detecting (or checks for the double feeding), for instance, a step-by-step weakness of the transmission light when two partially overlapped sheets are fed. However, as discussed in relation to the sensor 14 shown in FIG. 32, the sensor 620 is not so accurate as may determine by itself the thickness of sheets having varied properties. The sensor 630 is also a sensor that detects the sheet edge, but used to determine the timing at which the reader part 400 reads an image. The sensor 618 checks whether the sheet is ejected from the sheet feed mechanism 300 to the ejection part 500. These sensors 610–640 may be, for instance, a transmission type photosensor consisting of a light-emitting element and a light-receiving element, but a reflection type photosensor may also be usable. In addition, the image capture device 1000 may include a sensor that may detect a width of a sheet.

Referring now to FIGS. 3 to 19 inclusive, a description will be given of the operation part 700. The operation part 700 may be configured as an operator panel provided at a front surface of the housing 900. The operator panel 700 includes a display 710, and a variety of operation buttons 720. The display 710 includes a variety of indicators (such as DATA, ALARM, and POWER). The operation buttons 720 include a menu button (MENU) 722, an entry button (ENTER) 724, a cancel button (CANCEL) 726, a variety of function buttons (F1 through F3) 728 through 732, and other kinds of selection buttons 740. A braking force applied to the brake roller 206 may be indicated on the display 710 in the operator panel 700, and set at a desired level by a user with the operator panel 700.

The indicator 712 illuminates, for instance, when the image capture device 1000 is in data communication with a host processor. The indicator 714 is lit up, for instance, when a double feed and a jam occur. The indicator 716 stays on, for instance, when the image capture device 1000 is energized. The indicator 718 illuminates, for instance, when the reader part 400 is reading a sheet. Each operation button 720 is assigned a predetermined function, so that settings may be made on operation necessary to capture images or the like.

Referring now to FIGS. 20 and 21, a description will be given of the controller 800. The controller 800 is connected with device mechanical parts (122, 200, 341, 412, 414, 422, 424, 432, and 434) through a junction board 802. The controller 800 is supplied with power from an external power source, and includes a main board 808 and other elements. If an endorser (for an endorsement printer) is provided near the end of the sheet feed path 310, a printer driver (or an endorser driver) is provided on the device mechanical part, and controlled by the controller 800. Auxiliary print plates, if provided thereon, are controlled through the controller 800. As shown in FIG. 21, the controller 800 includes a mechanical controller 810 and an image controller 820, and the mechanical controller 810 exercises the inventive control, which will be described later. The image controller 820 controls an image processing, and any construction known in the art can be used, and thus a detailed description will now be omitted.

Figure 22:
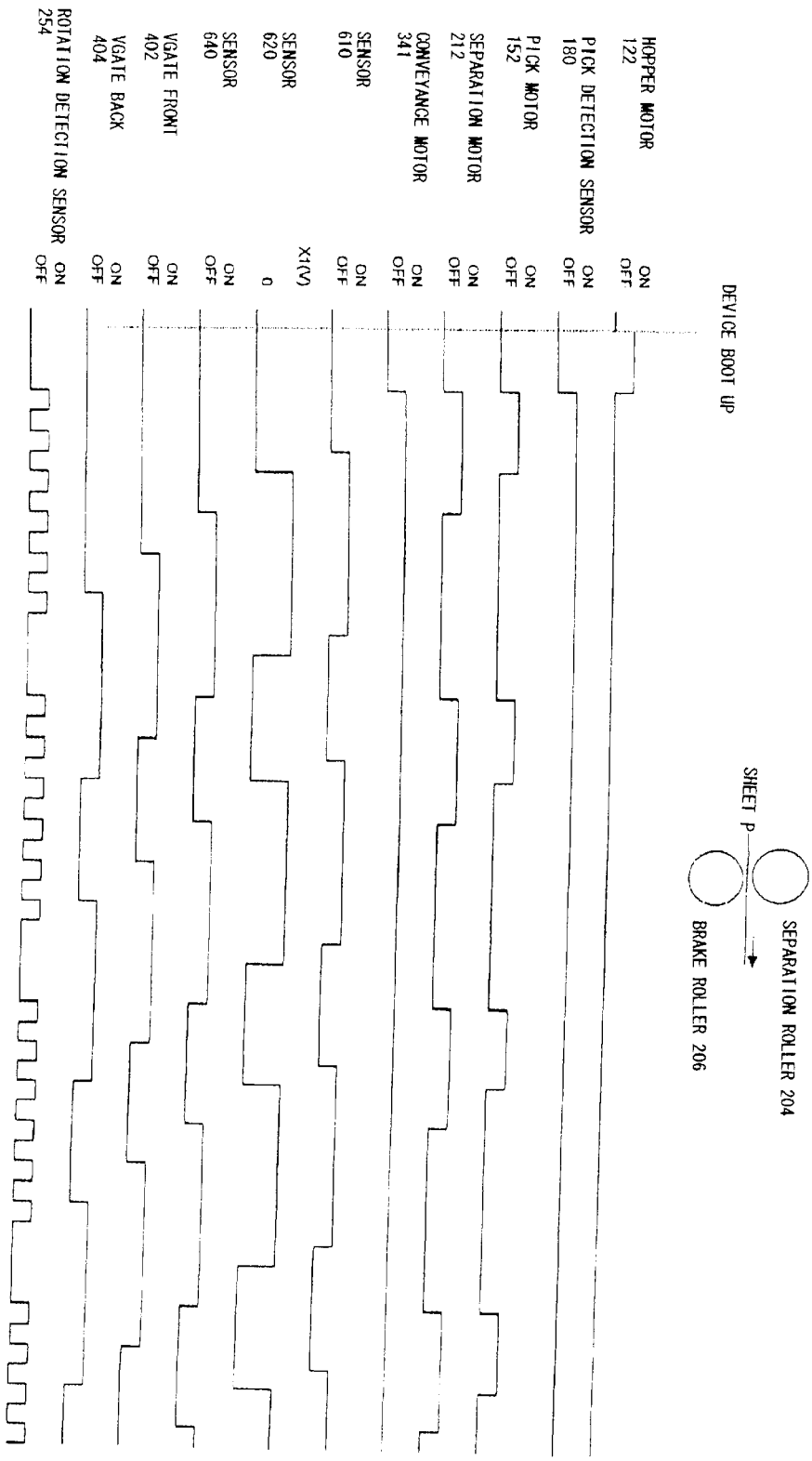
FIG. 22 is a timing chart for indicating a basic operation of the document feeder shown in FIG. 1.
Figure 23:
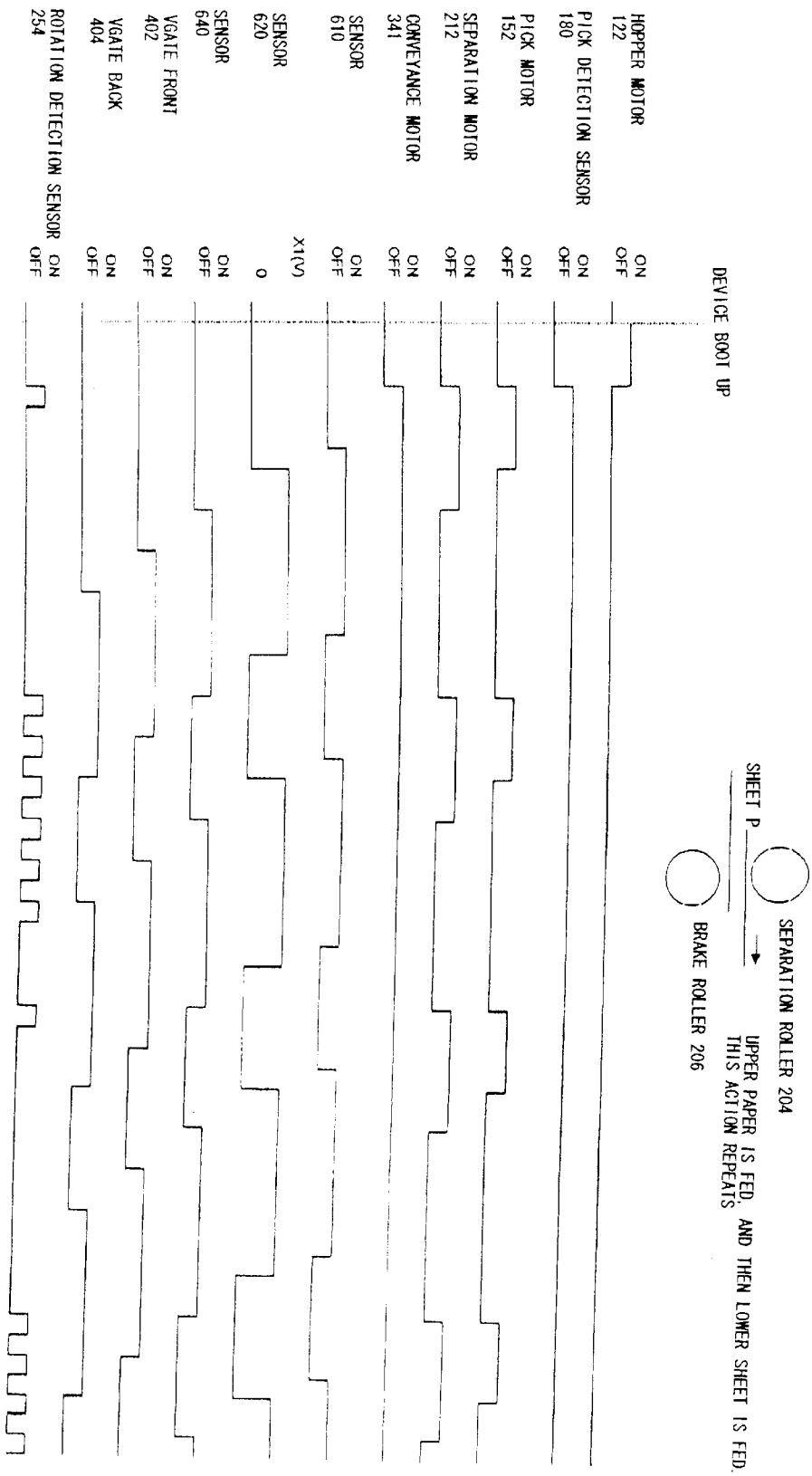
FIG. 23 is a timing chart for indicating another basic operation of the document feeder shown in FIG. 1.
Figure 24:
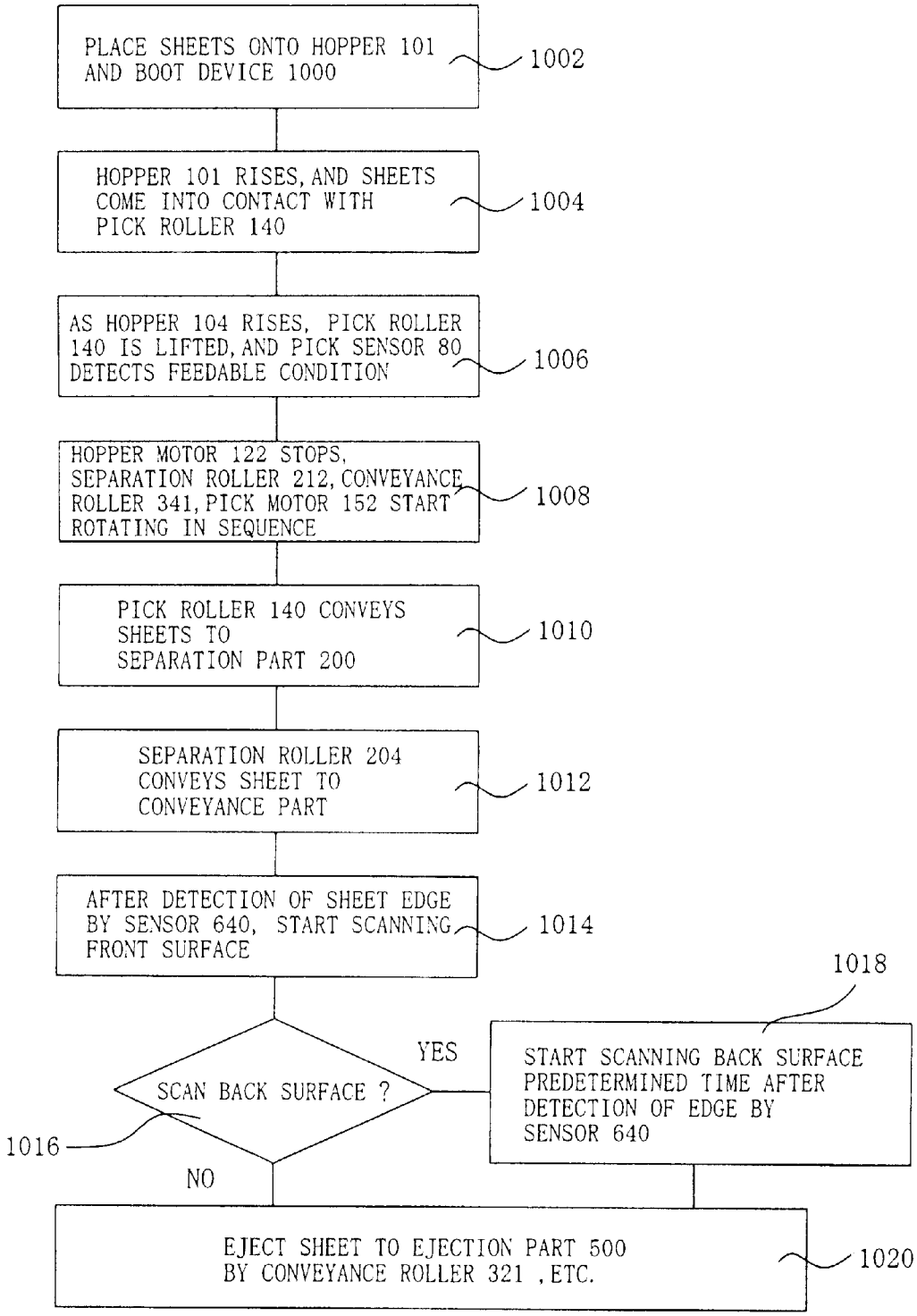
FIG. 24 is a flowchart for showing a basic operation of the document feeder shown in FIG. 1.

Referring now to FIGS. 22 to 24 inclusive, a description will be given of a basic feed control by the controller 800. Hereupon, FIGS. 22 and 23 are timing charts of basic feed operations of the document feeder 100. FIG. 22 indicates a basic operation where one sheet is introduced between the separation roller 204 and the brake roller 206. FIG. 23 indicates another basic operation where two sheets are introduced between the separation roller 204 and the brake roller 206, and one of them is caught by the brake roller 206. FIG. 24 is a flowchart that indicates a basic feed operation of the document feeder 100.

First, a user loads a stack of sheets LP onto the hopper 10, and boots the device (step 1002). Before the stacked sheets LP is set, the hopper 110 has descended sufficiently. The boot of the device include electrifications not only to the image capture device 100, but also to the host (such as a personal computer) connected with the image capture device 1000. The controller 800 drives, in response to a read command from the host, the hopper motor 122 to move up the hopper 110 (step 1004). Since the hopper 110 has not reached a feedable position yet at this point, the sensor 180 remains OFF. When the sensor 180 detects that the hopper 110 has reached the sheet feedable position and sheets contact the pick roller 142 (step 1006), the controller 800 stops the hopper motor 122. In feeding, the sheets in the hopper 110 decrease as the feed proceeds, and the hopper 110 changes its position accordingly. During this period, the controller 800 also controls the hopper motor 122 according to information detected by the sensor 180, and makes the hopper 110 (and the pick roller 142) ready to feed. If the sensor 180 detects that they are ready to feed, the controller 800 drives the pick motor 152, separation motor 212, and conveyance motor 341 (step 1008). Consequently, the pick roller 142, separation roller 204, and timing belt 350 rotate accordingly.

The pick motor 152 stops when one or more top sheets are fed. As a consequence, the pick roller 142 can feed sheet(s) to the separation part 200, while preventing a subsequent sheet from colliding with the previous sheet(s) and causing jamming (step 1010). The timing of turning off follows an output of the sensor 620 as will be described later. Similarly, when two sheets are initially fed, the separation motor 212 works during a period sufficient to feed only the upper sheet, and then stops. The timing of turning off also follows the output of the sensor 640 as will be described later. As a result, the separation roller 204 can feed the sheet to the conveyor part 300, while preventing the sheets caught by the brake roller 206 from going immediately and causing jamming (step 1012). On the other hand, the conveyor motor 341 is turned on after sensor 180's output turns on, thereby keeping on feeding a sheet. The conveyor motor 341 sets, for example, a low-speed mode at a speed $V_1$ (e.g., 12–13 cm/s), a high-speed mode at a speed $V_2$ (e.g., approximately 50 cm/s), and a middle-speed mode in-between, and conveys the first sheet in the low-speed mode after the feed begins. Accordingly, the pick roller 142 and separation roller 204 each use a low speed for feeding. Alternatively, the conveyor motor 341 may maintain its rotation in accordance with a sheet size and a capturing resolution.

As the edge of the first sheet passes by the sensors 610 and 620, the sensors 610 and 620 detect it and turn on, then the pick motor 152 turns off in response to turning on of the sensor 620. At this point, the sheet has reached a position where it is ready to be driven by the separation roller 204, and then starts to be driven by the separation roller 204. Next, as the sheet edge passes by the sensor 640, the sensor 640 detects it and turns on, and then the separation motor 212 turns off. At this point, the sheet has reached a position where it is ready to be driven by the conveyor rollers 321 etc., and then starts to be driven by the conveyor rollers 321 etc. At this point, the conveyor motor 341 rotates in the low-speed mode, and thus the conveyor rollers 321 etc., convey the sheet at a low speed. Alternatively, the conveyor motor 341 may maintain a specific rotation.

FIG. 22 shows a timing chart when one sheet is introduced between the separation roller 204 and the brake roller 206, while FIG. 23 shows a timing chart when two sheets are introduced between the separation roller 204 and the brake roller 206. As will be readily understood by comparing FIGS. 22 and 23 with each other, an output of the rotation-detecting sensor 254 that detects a rotary state of the brake roller 206 is continuously produced in FIG. 22 since the brake roller 206 rotates as the separation roller 212 is driven. On the other hand, referring to FIG. 23, while the upper sheet is fed, the brake roller 206 catches the lower sheet and thus stops during this period; there is no output from the rotation-detecting sensor 254. When the lower sheet is fed, the brake roller 206 rotates, and thus an output of the rotation-detecting sensor 254 is produced in the same manner as in FIG. 22. In FIG. 23, the sheet feed repeats as follows where the upper sheet is conveyed, and then the lower sheet is conveyed.

The sensor 640 detects the readout timing for the reader part 400. When the sensor 640 detects that the sheet has passed by, a read command is accordingly issued. The conveyor motor 341 accelerates. in response to the read command, to switch from the low-speed mode (at the speed $V_1$) to the high-speed mode (at the speed $V_2$). Consequently, the conveyor rollers 323–329 also accelerate its rotation or feed speed switching to the high-speed feeding. Some time after the sheet edge passes by the sensor 640, the optical image reader unit 402 that reads information on the front surface of the sheet is switched to a read state (or a state where a video gate (VGATE) for the front side turns on) (step 1014), and if a back surface is selected (step 1016), some time after the sheet edge passes by the sensor 640, the optical capture unit 404 that reads information on the back surface of the sheet is switched to a read state (or a state where a video gate (VGATE) for the back side turns on) (step 1018). Each of the image capture units 402 and 404 switches the video gate from on to off after a certain time period required to read an image has passed, and then completes reading. This time period is generally given as a product of the number of scan lines and an integral time.

For the second and following sheets, the conveyor motor 341 runs in the high-speed mode from the beginning, and is thus differently controlled so as to transiently reduce its speed when the sheet driver is to be switched from the separation roller 204 to the conveyance roller 341. The read out sheet is ejected by the conveyor rollers 321 etc. to the ejection part 500 (step 1020).

Figure 25:
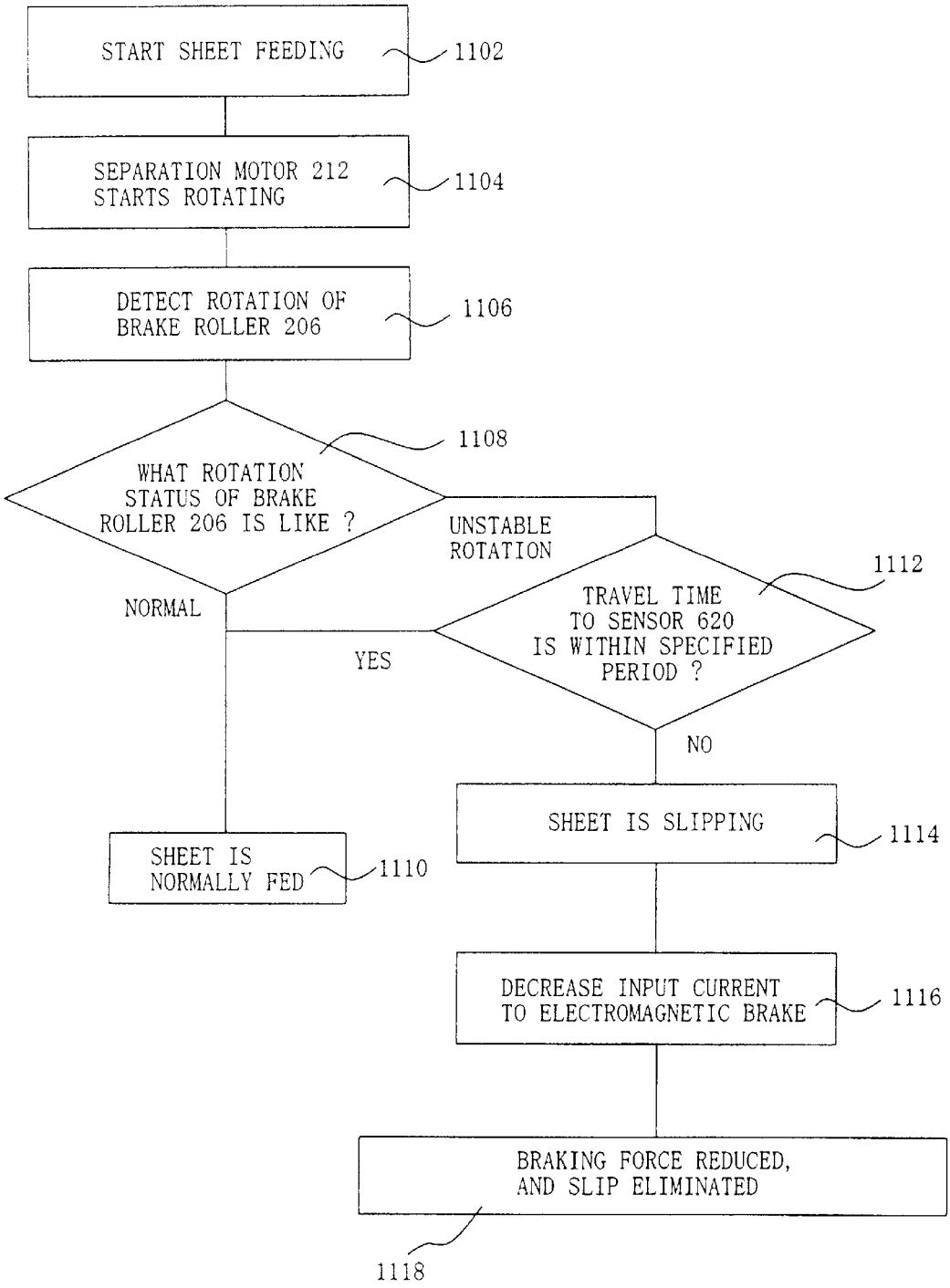
FIG. 25 is a flowchart for showing an operation of the document feeder shown in FIG. 1 that changes a braking force.
Figure 26:
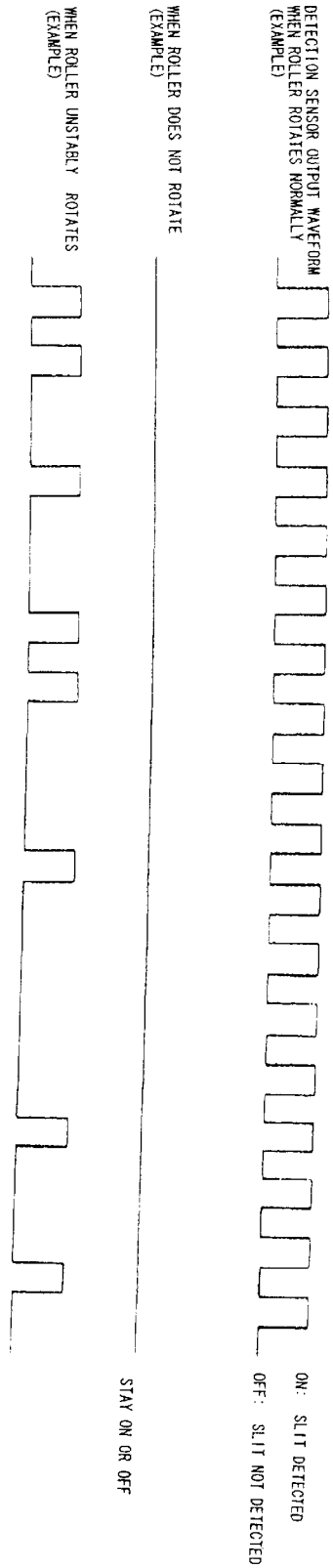
FIG. 26 is a timing chart for indicating an output from a sensor in the rotation detector shown in FIG. 7 depending upon a state of the brake roller in the document feeder shown in FIG. 1.
Figure 27:
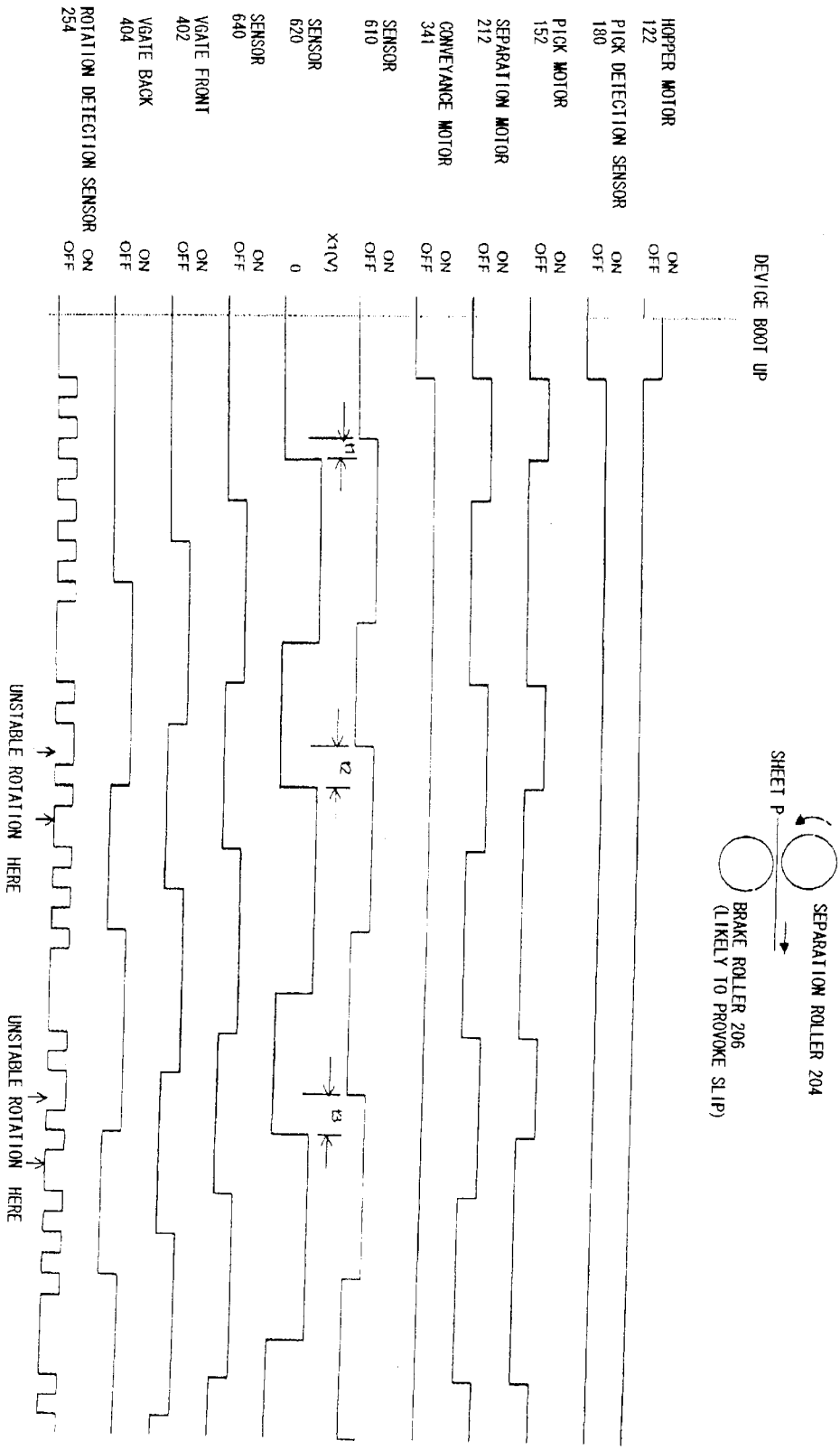
FIG. 27 is a timing chart partially used for the flowchart shown in FIG. 25.

Referring now to FIGS. 25 through 27, a description will be given of controls by the controller 800 over a braking force of the electromagnetic brake 230. Hereupon, FIG. 25 shows a control flowchart performed when one sheet fed to the sheet separation mechanism 200 from the pick roller 142 slips on the brake roller 206. FIG. 26 shows waveforms output from the sensor 254 for each rotary state of the brake roller 206. FIG. 27 is a timing chart when one sheet fed to the sheet separation mechanism 200 from the pick roller 142 slips on the brake roller 206. Since sheets of various properties according to recent users' preferences are possibly used under various circumstances for the image capture device 1000, the braking force applied to the brake roller 206 should be regulated.

As described above with reference to the steps 1002–1008, the controller 800 initially starts sheet feeding according to an instruction by the host, and drives the separation motor 212 (steps 1102 and 1104). Next, the controller 800 receives information on the rotary status of the brake roller 206 from the sensor 254 (step 1106). As shown in the upper row in FIG. 26, when the brake roller 206 normally rotates, an on/off cycle of the sensor 254 repeats at a regular interval. On the contrary, as shown in the lower row in FIG. 26, when the brake roller 206 rotates unstably, the on/off cycle of the sensor 254 becomes irregular. The controller 800 checks whether the brake roller 206 rotates normally (step 1108), and determines that there is normal feeding when the brake roller 206 rotates normally (step 1110).

If the brake roller 206 rotates irregularly, the controller 800 checks whether a sheet travel time from the sensor 610 to the sensor 620 (i.e., a time period between a leading edge of the sensor 610 and that of the sensor 620) is within a specified period (step 1112). The controller 800 determines, when judging that the sheet travel time from the sensor 610 to the sensor 620 is within the specified period, that there is normal feeding even when the brake roller 206 rotates irregularly (step 1110). In this case, the controller 800 determines that the sheet is being fed substantially normally.

The controller 800 may alternatively use a time period from a startup of the device in FIG. 22 to the leading edge of the sensor 610, an electrification period of the pick motor 152, and another time period. For example, the controller 800 may include a pulse counter (not shown), and measure the sheet travel time to the sensor 610 by counting the number of pulses generated from the startup of the device to the leading edge of the sensor 610.

When the controller 800 determines, when judging that the sheet travel time from the sensor 610 to the sensor 620 is longer than the specified period, that the sheet slips on the brake roller 206 (step 1114), and concludes that the braking force to the brake roller 206 is too strong. The specified period may be obtained from a tentative feed of one sheet or real feed of the first sheet, and may be stored as a reference value in a memory (not shown) of the image capture device 1000.

The outputs of the sensors 610 and/or 620 vary with sheets' properties, and thus the reliance only upon the outputs of these sensors in checking for a sheet slippage would possibly lower the reliability in determination. Therefore, the controller 800 in this embodiment does not rely only upon the outputs of these sensors, but combines an output of the rotation-detecting sensor 254 with them, thereby improving the reliability in checking for the sheet slippage. FIGS. 26 and 27 show unstable rotations detected by the rotation-detecting sensor 254. In FIG. 27, the relationship among the specific time period tb and travel time periods t1–t3 is tb>t1, tb<t2, t3, and the controller 800 judges the former as no slip (or within a permissible range), and the latter as slipping (or beyond the permissible range).

When the controller 800 reduces, when determining a slippage, the braking force by decreasing an input current (e.g., by 10%) to the electromagnetic brake 230 so as to eliminate the slippage (steps 1116 and 1118). The controller 800 may arbitrarily set up a ratio to reduce the input current.

Figure 28:
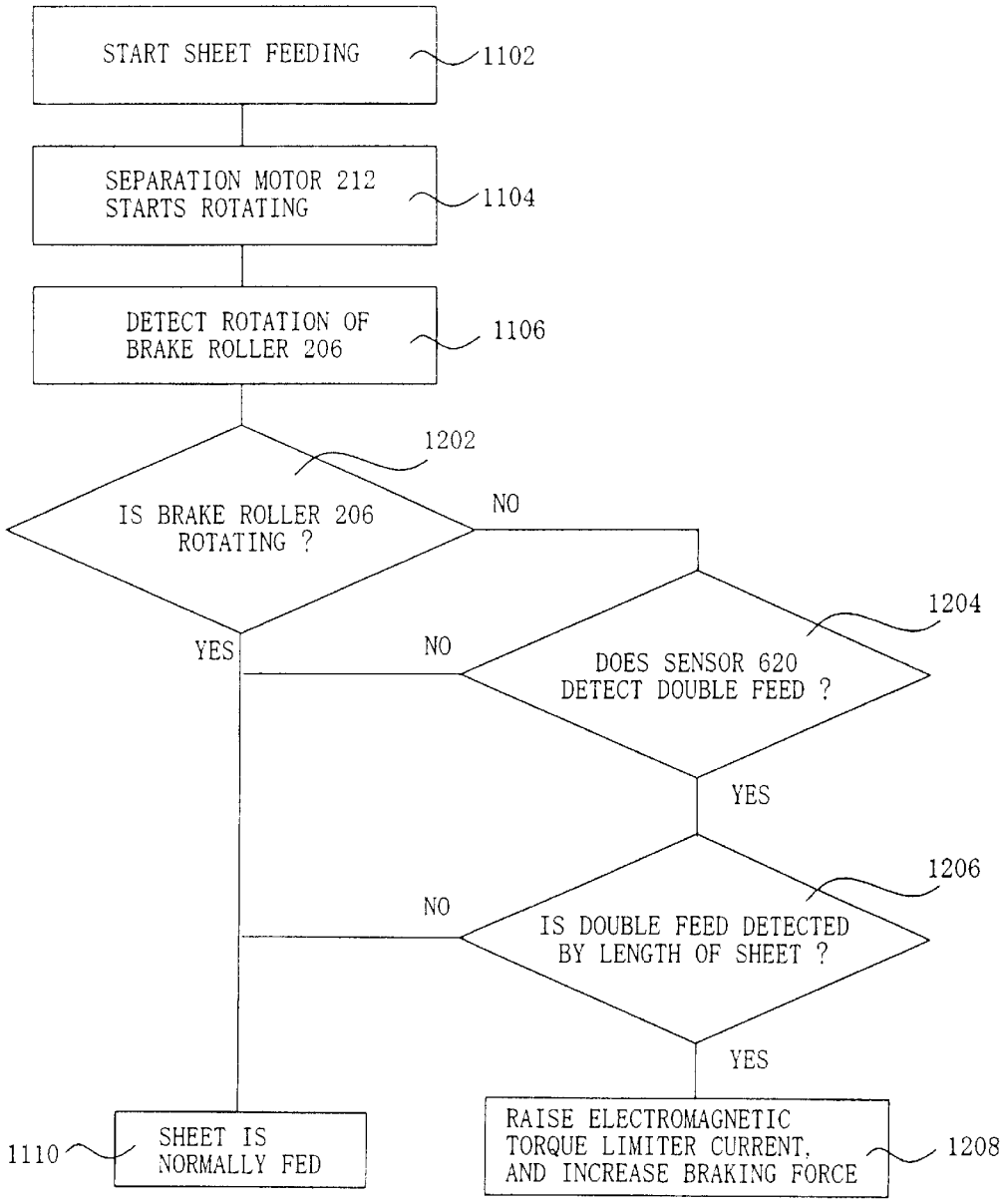
FIG. 28 is a flowchart for showing an operation of the document feeder shown in FIG. 1 that detects the double feeding.
Figure 29:
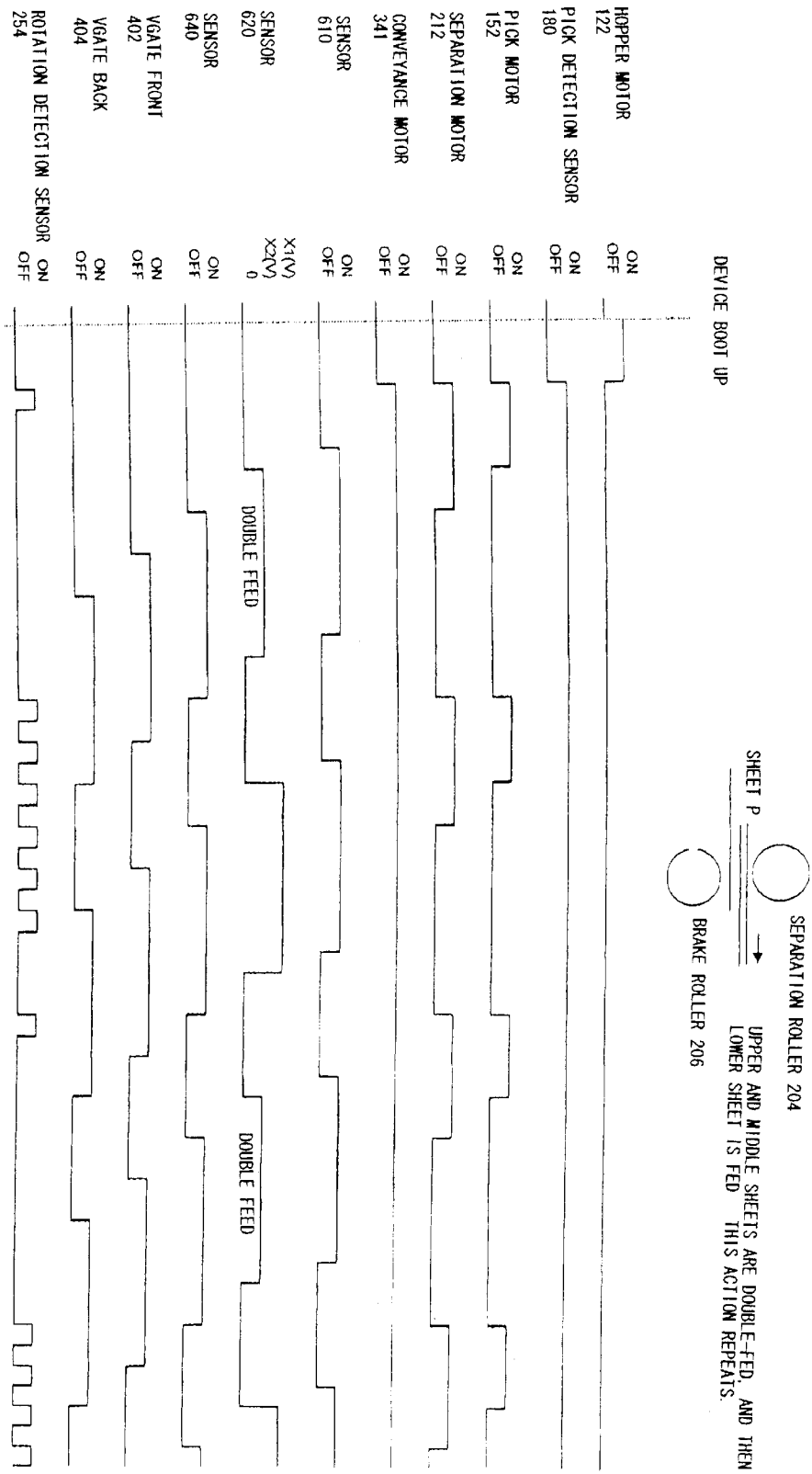
FIG. 29 is a timing chart partially used for the flowchart shown in FIG. 28.

Referring now to FIGS. 28 and 29, a description will be given of another control by the controller 800 over the braking force of the electromagnetic brake 230. Hereupon, FIG. 28 shows a control flowchart for the controller 800 to detect a double feed. FIG. 29 is a timing chart for showing a case where three sheets are introduced between the separation roller 204 and the brake roller 206, one sheet is then caught by the brake roller 206, and the other two top sheets are fed.

As described above with reference to the steps 1002–1008, the controller 800 starts sheet feeding according to an instruction by the host, and drives the separation motor 212 (steps 1102, 1104). Next, the controller 800 receives information on the rotary status of the brake roller 206 from the sensor 254 (step 1106). The sensor 254 then informs controller 800 of information on whether the brake roller 206 is rotating (step 1202). The controller 800 concludes, when determining that the brake roller 206 is rotating, that the sheet is fed normally (step 1110).

On the other hand, if the controller 800 determines that the brake roller 206 is not rotating, then the controller 800 judges whether the sensor 620 has detected a double feed (step 1204). When the brake roller 206 is not rotating, the sensor 254 exhibits outputs as shown in the middle row of FIG. 26. The fact that the brake roller 206 is not rotating means that the brake roller 206 holds at least one sheet. In step 1204, the sensor 620 may detect a double feed from its transmittance. As may be understood from FIG. 29, if the sensor 620 detects half the transmittance of the output detected when one sheet is being fed, the controller 800 determines that the sensor 620 has detected a double feed.

This event possibly occurs when three or more sheets are fed between the separation roller 204 and the brake roller 206, and in particular, is more likely to occur when various types of sheets are fed, i.e., when a frictional force between sheets is not constant. In this event, the sheet in contact with the brake roller 206 stays still on the brake roller 206 because a braking force with the brake roller 206 is greater than an inter-sheet feeding force with the adjacent upper sheet. However, a middle sheet may cause a double feed depending upon the relationship between the inter-sheet frictional forces with adjacent upper and lower sheets. The controller 800 in this embodiment determines a double feed when the brake roller 206 stops and the sensor 620 detects two or more sheets (step 1206).

The output of the sensor 620 varies with sheets' properties, and thus the reliance only upon the output of the sensor 620 in checking for a double feed would possibly lower the reliability in determination. Therefore, the controller 800 in this embodiment does not rely only upon the output of the sensor 620, but combines an output of the rotation-detecting sensor 254 with that of the sensor 620, thereby improving the reliability in checking for the double feed. Whereas the prior art cannot disadvantageously detects a double feed reliably because of unstable outputs of the transmission sensor 14, the present embodiment reliably determines the double feed by combining a detected rotary state of the brake roller 206.

Optionally, the step 1206 may be added to the step 1204 to further improve the reliability. The step 1206 checks if there is a double feed based on the sheet length. The sheet length can be calculated, for instance, from a time period from a leading edge to a trailing edge of the sensor 620. The controller 800 concludes, when determining no double feed detected by the sheet length, that the sheet is fed normally (step 1110). The controller 800 increases, when determining that a double feed is detected by the sheet length, an input current to the braking force so as to increase it (step 1208). Increase of the braking force has an effect of holding the middle sheet on the brake roller 206, substantially preventing the double feed. Alternatively, when determining the existence of a double feed the controller 800, for example, may turn on the indicator 714 of the operator panel 700 and/or display a message on the display 710.

The sheet length may be worked out based upon a sheet passage time detected by the sensor 610. Control over the electromagnetic brake 230 so as to automatically increase its braking force may be provided to prevent a double feed. The double feed occurs when a feeding force between fed sheets (a frictional force generated between the first and next sheets to forward the subsequent sheet) exceeds a force required to drive the brake roller 206. As described with reference to FIG. 15, a relationship $Tr \times i/r > \mu p \times Ps$ is required to eliminate the double feed.

Figure 30:
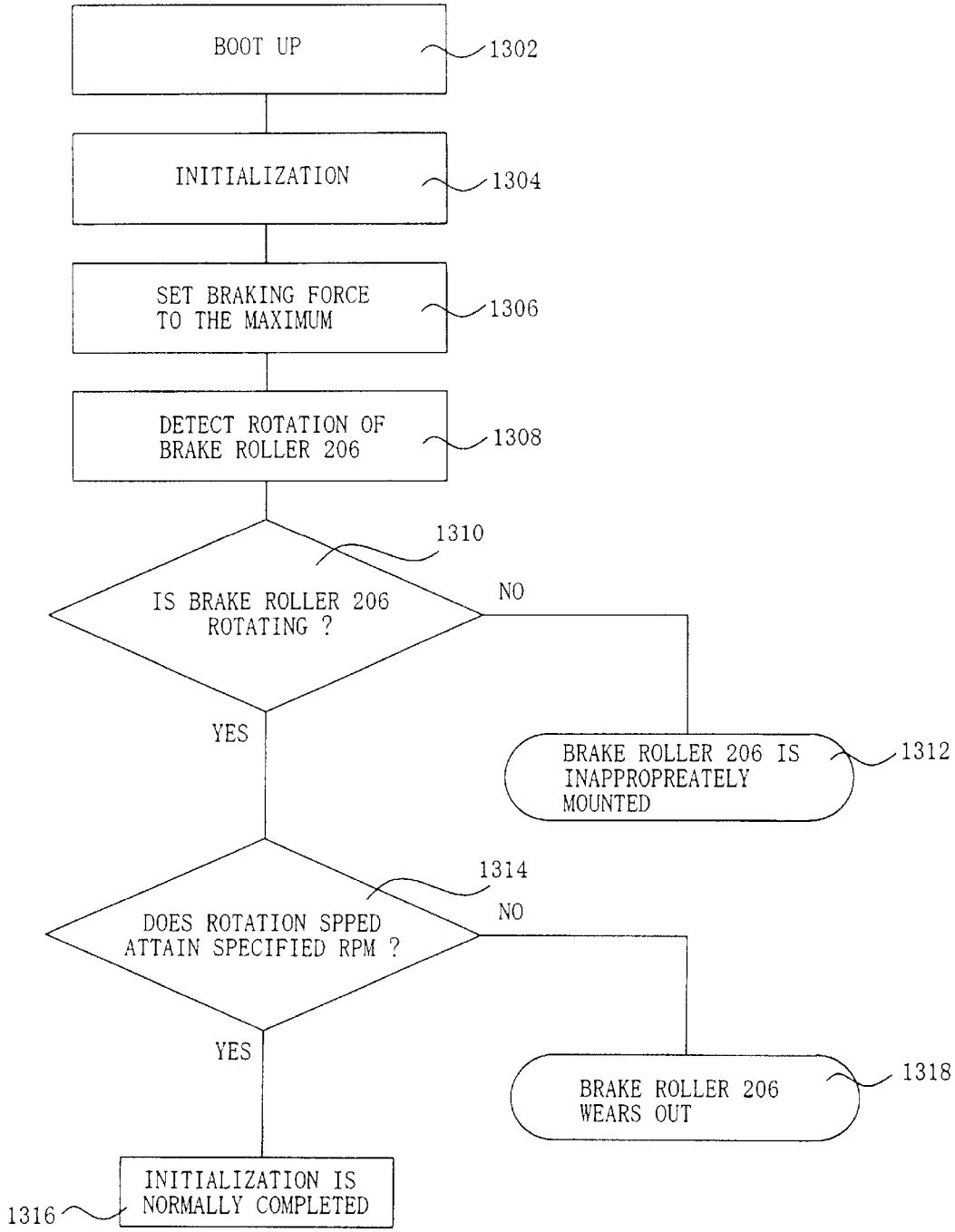
FIG. 30 is a flowchart for showing another operation of the document feeder shown in FIG. 18.

Referring now to FIG. 30, a description will be given of how the controller 800 detects, at an initial operation, a bad installation of the brake roller unit 260 and a wearing out of the brake roller 206. Hereupon, FIG. 30 is a flowchart for explaining how the controller 800 detects, at an initial operation, a bad installation of the brake roller unit 260 and a wearing out of the brake roller 206. This embodiment premises that the braking force applied to the brake roller 206 is changeable at two or more stages.

When the device is booted up (step 1302), the controller 800 goes to an initialization mode (step 1304) and sets the braking force to the maximum by supplying the maximum input current to the electromagnetic brake 230 (step 1306). Although this embodiment uses the maximum input current, any level of input current is usable. The controller 800 then detects the rotary state of the brake roller 206 using an output of the sensor 254 (steps 1308 and 1310). If the brake roller 206 is not rotating, the controller 800 determines that the brake roller unit 260 is not mounted or inappropriately mounted (step 1312). The controller 800 can determines from an output of the sensor 254 that the brake roller 206 is not rotating. When the brake roller 206 is rotating at a rotation speed below a specified rpm, the controller 800 determines that the brake roller 206 is worn out (step 1318). The controller 800 may determine the rotary speed of the brake roller 206 from a cycle (e.g., a leading edge) of the sensor 254. Consequently, a user may eliminate the excessive wearing and abnormal wearing (where part are worn out unevenly) of the brake roller 206, thereby preventing slippage and/or jamming upon the sheet separation. If the brake roller 206 rotates and its rotary speed reaches a specified rpm, the controller 800 completes the initial operation normally (step 1316).

Figure 31:
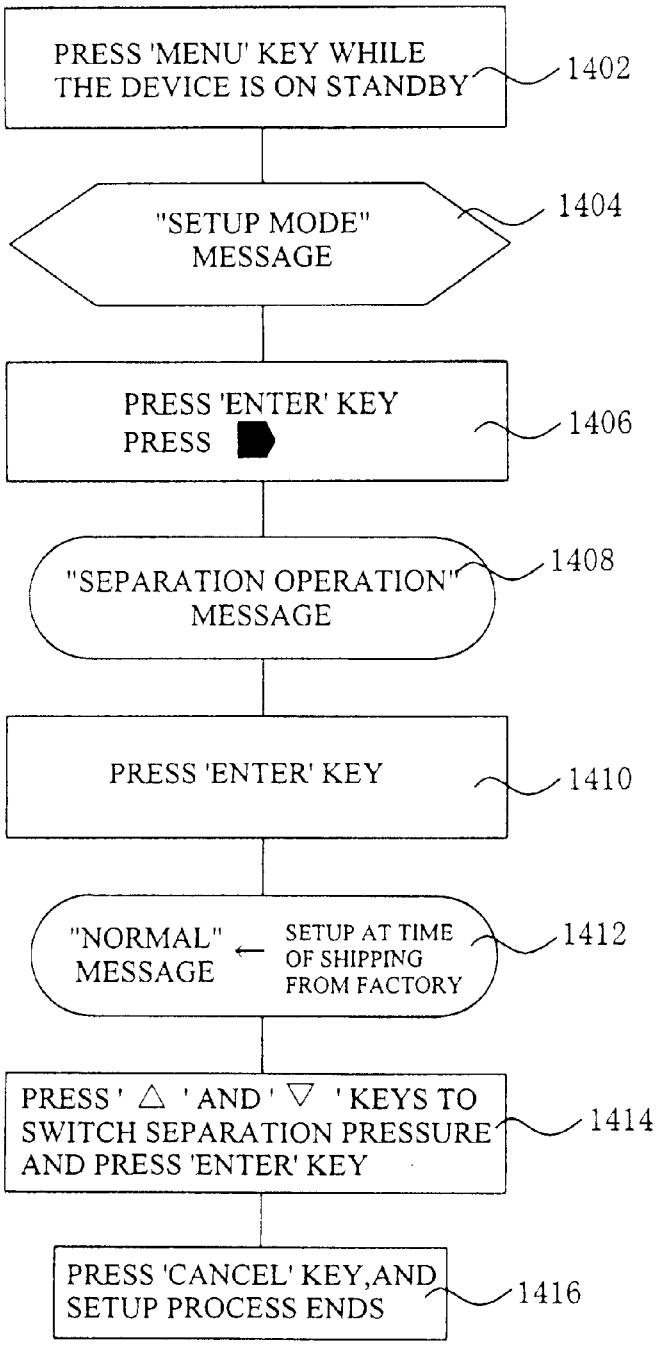
FIG. 31 is a flowchart for explaining an operation of the operator panel shown in FIG. 17.

Referring now to FIG. 31, a description will be given of an exemplified procedure of varying a braking force with the operator panel 700. A user presses the menu button 722 while the device is on standby (step 1402). Then "Setup Mode" shows up on the display (step 1404), and the user presses the entry button 724 (step 1406). Next, "Separation Operation" shows up (step 1408), and the entry button 724 is pressed (step 1410). "Normal" is then shown on the display, which has been setup at the time of shipping from a factory (step 1412). The selection button 740 is operated to switch the braking force to a desired one, and then the entry button 724 is pressed (step 1414). For instance, the message "Thick" corresponds to a strong braking force; the message "A Little Thick" corresponds to a little strong braking force; the message "A Little Thin" corresponds to a little weak braking force; and the message "Thin" corresponds to a weak braking force. Pressing of the cancel button ends a setup of the braking force (step 1416).

A user may tentatively feed a sheet and set the braking force in an initialization or calibration mode after the device starts to be run. In these modes, the braking force may be set automatically by the controller 800 or manually by a user observing a tentative sheet feeding with his eyes and operator panel 700. In this event, the image capture device 1000 may preferably include a mode selector that switches between the initialization or calibration mode, and the normal scan mode. After the mode selector switches the calibration mode, a braking force for a tentatively fed sheet is determined automatically by the controller 800 or manually by a user.

Further, the present invention is not limited to the above-preferred embodiments, but various variations and modifications may be made without departing from the spirit and scope of the present invention. For instance, the brake torque Tr is made variable in this embodiment, but the separation load Ps may be made variable along with or instead of the brake torque Tr.

The document feeder, document feed method, and image capture device as one exemplified embodiment of the present invention properly adjust a braking force in accordance with varied types of sheets. thus preventing a jam, slip, double feed, or the like, and feeding various types of sheets stably.

In addition, the document feed method as another exemplified embodiment of the present invention checks for a double feed by taking into account a moving state of the second separation portion, thus providing a higher reliability than a judgment method based only on a measurement result of a sheet feed time. Therefore, the inventive document feed method can appropriately eliminate troubles such as a poor reading.

What is claimed is:

1. A document feeder comprising:

a pull-in portion that contacts a topmost sheet among a plurality of sheets and feeds one or more sheets including said topmost sheet; and a sheet separation mechanism that restricts the number of sheets to be fed by said pull-in portion, wherein said sheet separation mechanism includes:

a first separation portion that contacts said sheet, and moves so as to feed the sheet;

a second separation portion, located opposite to said first separation portion, which defines a part of a sheet feed path between said second and first separation portions, and moves so as to allow the sheet to be fed, said second separation portion having a roller for contacting and feeding the sheet; and a brake portion that variably applies, in accordance with a feeding status of the sheet, to said second separation portion a load allowing said second separation portion to move, the load being set constant when said second separation portion moves.

2. A document feeder according to claim 1, further comprising a detector that detects a moving condition of said second separation portion, wherein said brake portion varies said load according to a detection result by said detector.

3. A document feeder according to claim 1, further comprising a mode selector that selects a calibration mode which introduces a sheet tentatively, wherein said brake portion determines, when said mode selector selects said calibration mode, said load for the sheet that is tentatively introduced.

4. A document feeder according to claim 1, further comprising an input portion that allows a user to assign said load to be applied by said brake portion.

5. A document feeder according to claim 1, wherein said brake portion varies said load in multiple stages.

6. A document feeder according to claim 1, further comprising a fulcrum around which said second separation portion rotates, said fulcrum being located on an extension of said sheet feed path defined by said first and second separation portions.

7. A document feeder according to claim 1, wherein said brake portion includes a universal joint, and applies said load to said second separation portion through said universal joint.

8. A document feeder according to claim 1, wherein said brake portion includes an electromagnetic brake.

9. A document feeder according to claim 8, wherein said electronic magnetic brake is a pure electromagnetic coupling type.

10. An image capture device comprising:

a document feeder; and a reader part that reads out information on a sheet that is fed by said document feeder, wherein said document feeder includes:

a pull-in portion that is movable relative to a topmost sheet among a plurality of sheets so as to contact said topmost sheet, and feeds one or more sheets including said topmost sheet; and a sheet separation mechanism, located at a downstream from said pull-in portion in a sheet feed direction, and restricts the number of sheets to be fed by said pull-in portion, wherein said sheet separation mechanism includes:

a first separation portion that contacts said sheet, and moves so as to feed said sheet downstream in the sheet feed direction;

a second separation portion, located opposite to said first separation portion, which defines a part of a sheet feed path between said second and first separation portions, and moves so as to allow said sheet to be fed, said second separation portion having a roller for contacting and feeding the sheet; and a brake portion that variably applies, in accordance with a feeding status of the sheet, to said second separation portion a load defining a driving force allowing said second separation portion to move, the load being set constant when said second separation portion moves.

11. A document feed method comprising the steps of:

sequentially pulling in stacked sheets from a top thereof;

restricting using a sheet separation mechanism the number of sheets to be fed, said sheet separation mechanism including a first separation portion that contacts said sheet and move so as to feed said sheet along a sheet feed path, a second separation portion, located opposite to said first separation portion, which defines a part of the sheet feed path between said second and first separation portions, and moves so as to allow the sheet to be fed;

detecting a moving condition of said second separation portion;

determining whether a double feeding of said sheets has occurred; and measuring a feed time of said sheet, wherein said determining step determines that there is the double feeding of said sheets, when said measuring step measures that said feed time of said sheet is longer than a reference value, and said detecting step detects one of a motionless and improper movement of said second separation portion.

12. A document feed method comprising the steps of:

sequentially pulling in stacked sheets from a top thereof;

restricting using a sheet separation mechanism the number of sheets to be fed, said sheet separation mechanism including a first separation portion that contacts said sheet, a second separation portion, located opposite to said first separation portion, which defines a part of a sheet feed path between said second and first separation portions, and moves so as to allow the sheet to be fed, said second separation portion having a roller for contacting and feeding the sheet; and applying variably, in accordance with a feeding status of the sheet, to said second separation portion a load allowing said second separation portion to move, the load being set constant when said second separation portion moves.

13. A document feed method according to claim 13, further comprising a step of detecting a moving condition of said second separation portion, wherein said load applying step reduces said load, when only one sheet is fed to said sheet separation mechanism, and said detecting step detects one of a motionless and improper movement of said second separation portion.

14. A document feed method according to claim 12, further comprising a step of determining whether a double feed of said sheets has occurred, wherein said load applying step increases said load when said determining step determines that the double feeding has occurred.

15. A document feed method according to claim 12, further comprising the steps of:

detecting a moving condition of said second separation portion; and determining whether said second separation portion is properly installed, wherein said determining step determines that said second separation portion is not properly installed when said load applying step applies a predetermined load, and said detecting step detects a motionless and improper movement of said second separation portion.

16. A document feed method according to claim 12, further comprising the steps of:

detecting a moving condition of said second separation portion; and determining whether a mechanical defect exists in said second separation portion, wherein said determining step determines that the mechanical defect exists in said second separation portion, when said load applying step applies a predetermined load, and said detecting step detects a motionless and improper movement of said second separation portion.

* * * * *